US012173708B1

(12) United States Patent
Butler et al.

(10) Patent No.: US 12,173,708 B1
(45) Date of Patent: Dec. 24, 2024

(54) HEAT PUMP SYSTEMS WITH CAPACITY MODULATION

(71) Applicant: Copeland LP, Sidney, OH (US)

(72) Inventors: Brian R. Butler, Sidney, OH (US); Andrew M. Welch, Franklin, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/533,121

(22) Filed: Dec. 7, 2023

(51) Int. Cl.

| | |
|---|---|
| ***F04C 28/16*** | (2006.01) |
| ***F04C 18/02*** | (2006.01) |
| ***F04C 23/00*** | (2006.01) |
| ***F04C 28/10*** | (2006.01) |
| ***F04C 28/24*** | (2006.01) |
| ***F04C 29/00*** | (2006.01) |

(52) U.S. Cl.
CPC ..... *F04C 18/0215* (2013.01); *F04C 23/008* (2013.01); *F04C 28/24* (2013.01)

(58) Field of Classification Search
CPC ..... F04C 28/16; F04C 28/24; F04C 28/0265; F04C 18/0215; F04C 18/0261; F04C 23/008; F04C 29/0021
See application file for complete search history.

(56) References Cited

U.S. PATENT DOCUMENTS

| | | | |
|---|---|---|---|
| 3,303,988 | A | 2/1967 | Weatherhead |
| 3,777,508 | A | 12/1973 | Imabayashi et al. |
| 4,058,988 | A | 11/1977 | Shaw |
| 4,216,661 | A | 8/1980 | Tojo et al. |
| 4,313,314 | A | 2/1982 | Boyanich |
| 4,382,370 | A | 5/1983 | Suefuji et al. |
| 4,383,805 | A | 5/1983 | Teegarden et al. |
| 4,389,171 | A | 6/1983 | Eber et al. |

(Continued)

FOREIGN PATENT DOCUMENTS

| | | | |
|---|---|---|---|
| AU | 2002301023 | B2 | 6/2005 |
| CN | 1137614 | A | 12/1996 |

(Continued)

OTHER PUBLICATIONS

Advisory Action regarding U.S. Appl. No. 14/073,293, dated Apr. 18, 2016.

(Continued)

*Primary Examiner* — Deming Wan
(74) *Attorney, Agent, or Firm* — Harness, Dickey & Pierce, P.L.C.

(57) ABSTRACT

A compressor may include first and second scrolls and a capacity modulation assembly. The capacity modulation assembly may include a valve ring and a modulation control valve. The valve ring is movable relative to the first scroll between a first position corresponding to a first capacity mode and a second position corresponding to a second capacity mode. The modulation control valve includes a valve body and a valve member that is movable relative to the valve body to cause corresponding movement of the valve ring. The valve body includes a cavity in which the valve member is movably disposed. The valve body includes passages in fluid communication with the cavity. A first pressure differential between fluid in one of the passages and fluid in another of the passages causes movement of the valve member to cause corresponding movement of the valve ring between the first and second positions.

22 Claims, 14 Drawing Sheets

(56) References Cited

U.S. PATENT DOCUMENTS 4,466,784 A 8/1984 Hiraga
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,791,328 A 8/1998 Alexander
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.

(56) References Cited

U.S. PATENT DOCUMENTS 6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,112,046 B2 9/2006 Kammhoff et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
7,429,167 B2 9/2008 Bonear et al.
RE40,554 E 10/2008 Bass et al.
7,484,374 B2 2/2009 Pham et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,827,809 B2 11/2010 Pham et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,020,402 B2 9/2011 Pham et al.
8,025,492 B2 9/2011 Seibel et al.
8,079,229 B2 12/2011 Lifson et al.
8,162,622 B2 4/2012 Shoulders
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,328,543 B2 12/2012 Wilson
8,393,882 B2 3/2013 Ignatiev et al.
8,424,326 B2 4/2013 Mitra et al.
8,505,331 B2 8/2013 Pham et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,068,765 B2 6/2015 Huff
9,080,446 B2 7/2015 Heusler et al.
9,127,677 B2 * 9/2015 Doepker ..... F04C 18/0261
9,145,891 B2 9/2015 Kim et al.
9,169,839 B2 10/2015 Ishizono et al.
9,194,395 B2 11/2015 Ginies et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,360,011 B2 6/2016 Perevozchikov et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,605,677 B2 3/2017 Heidecker et al.
9,612,042 B2 4/2017 Sjoholm et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,850,903 B2 12/2017 Perevozchikov
9,869,315 B2 1/2018 Jang et al.
9,879,674 B2 1/2018 Akei et al.
9,885,347 B2 2/2018 Lachey et al.
9,920,759 B2 3/2018 Sung et al.
9,926,932 B2 3/2018 Perevozchikov et al.
9,989,057 B2 6/2018 Lochner et al.
10,066,622 B2 9/2018 Pax et al.
10,087,936 B2 10/2018 Pax et al.
10,088,202 B2 10/2018 Huff et al.
10,094,380 B2 10/2018 Doepker et al.
10,323,639 B2 6/2019 Doepker et al.
10,428,818 B2 10/2019 Jin et al.
10,563,891 B2 2/2020 Smerud et al.
10,724,523 B2 7/2020 Wu et al.
10,815,999 B2 10/2020 Jeong
10,907,633 B2 2/2021 Doepker et al.
10,954,940 B2 3/2021 Akei et al.
10,974,317 B2 4/2021 Ruxanda et al.
11,209,000 B2 12/2021 Moore et al.
11,231,034 B2 1/2022 Funakoshi et al.
11,300,329 B2 4/2022 Yan et al.
11,378,290 B2 7/2022 Locke et al.
11,493,040 B2 11/2022 Zou et al.
11,846,287 B1 12/2023 Gehret et al.
2001/0010800 A1 8/2001 Kohsokabe et al.
2002/0039540 A1 4/2002 Kuroki et al.
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.

(56) References Cited

U.S. PATENT DOCUMENTS

2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0003666 A1 1/2007 Gutknecht et al.
2007/0036661 A1 2/2007 Stover
2007/0110604 A1 5/2007 Peyton
2007/0130973 A1 6/2007 Lifson et al.
2007/0148026 A1 6/2007 Higashi
2007/0194261 A1 8/2007 Kato et al.
2008/0034772 A1 2/2008 Chumley et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0205345 A1 8/2009 Narayanamurthy et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0052437 A1 3/2011 Iitsuka et al.
2011/0135509 A1 6/2011 Fields et al.
2011/0174014 A1 7/2011 Scarcella et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0067070 A1 3/2012 Albertson
2012/0107163 A1 5/2012 Monnier et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0098071 A1 4/2013 Means
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0275898 A1 10/2015 Ahire et al.
2015/0300353 A1 10/2015 Utpat et al.
2015/0330386 A1 11/2015 Doepker
2015/0345493 A1 12/2015 Lochner et al.
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138732 A1 5/2016 Lively et al.
2016/0138879 A1 5/2016 Matsukado et al.
2016/0201673 A1 7/2016 Perevozchikov et al.
2016/0208803 A1 7/2016 Uekawa et al.
2016/0272047 A1 9/2016 Gan
2017/0002817 A1 1/2017 Stover
2017/0002818 A1 1/2017 Stover
2017/0030354 A1 2/2017 Stover
2017/0097108 A1 4/2017 Huff
2017/0241417 A1 8/2017 Jin et al.
2017/0268510 A1 9/2017 Stover et al.
2017/0306960 A1 10/2017 Pax et al.
2017/0314558 A1 11/2017 Pax et al.
2017/0342978 A1 11/2017 Doepker
2017/0342983 A1 11/2017 Jin et al.
2017/0342984 A1 11/2017 Jin et al.
2018/0023570 A1 1/2018 Huang et al.
2018/0038369 A1 2/2018 Doepker et al.
2018/0038370 A1 2/2018 Doepker et al.
2018/0066656 A1 3/2018 Perevozchikov et al.
2018/0066657 A1 3/2018 Perevozchikov et al.
2018/0135625 A1 5/2018 Naganuma et al.
2018/0149155 A1 5/2018 Akei et al.
2018/0216618 A1 8/2018 Jeong
2018/0223823 A1 8/2018 Ignatiev et al.
2019/0040861 A1 2/2019 Doepker et al.
2019/0041107 A1 2/2019 Piscopo et al.
2019/0101120 A1 4/2019 Perevozchikov et al.
2019/0162185 A1 5/2019 Mizushima et al.
2019/0186491 A1 6/2019 Perevozchikov et al.
2019/0203709 A1 7/2019 Her et al.
2019/0277288 A1 9/2019 Flanigan et al.
2019/0353164 A1 11/2019 Berning et al.
2020/0057458 A1 2/2020 Taguchi
2020/0291943 A1 9/2020 McBean et al.
2020/0370808 A1 11/2020 Feng et al.
2021/0262470 A1 8/2021 Wei et al.
2022/0065504 A1 3/2022 Zou
2022/0235774 A1 7/2022 Cui et al.

FOREIGN PATENT DOCUMENTS

CN 1158944 A 9/1997
CN 1158945 A 9/1997
CN 1177681 A 4/1998
CN 1177683 A 4/1998
CN 1259625 A 7/2000
CN 1286358 A 3/2001
CN 1289011 A 3/2001
CN 1339087 A 3/2002
CN 1349053 A 5/2002
CN 1382912 A 12/2002
CN 1407233 A 4/2003
CN 1407234 A 4/2003
CN 1517553 A 8/2004
CN 1601106 A 3/2005
CN 1680720 A 10/2005

(56) References Cited

FOREIGN PATENT DOCUMENTS

| | | | |
|---|---|---|---|
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1 241 417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 10-2001-0009403 | A | 2/2001 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130011864 | A | 1/2013 |
| KR | 20130094646 | A | 8/2013 |
| KR | 20140114212 | A | 9/2014 |
| KR | 10-2018-0094219 | A | 8/2018 |
| KR | 101917697 | B1 | 11/2018 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | 2019165254 | A1 | 8/2019 |
| WO | 2019222535 | A1 | 11/2019 |

OTHER PUBLICATIONS

Office Action regarding Chinese Patent Application No. 201380062657.4, dated May 4, 2016. Translation provided by Unitalen Attorneys at Law.

Office Action regarding Chinese Patent Application No. 201380059963.2, dated May 10, 2016. Translation provided by Unitalen Attorneys at Law.

Office Action regarding U.S. Appl. No. 14/060,102, dated Jun. 14, 2016.

Office Action regarding U.S. Appl. No. 14/846,877, dated Jul. 15, 2016.

Office Action regarding Chinese Patent Application No. 201410461048.2, dated Jul. 26, 2016. Translation provided by Unitalen Attorneys at Law.

Search Report regarding European Patent Application No. 13858194.7, dated Aug. 3, 2016.

Search Report regarding European Patent Application No. 13859308.2, dated Aug. 3, 2016.

Office Action regarding U.S. Appl. No. 14/294,458, dated Aug. 19, 2016.

Office Action regarding Chinese Patent Application No. 201410460792.0, dated Oct. 21, 2016. Translation provided by Unitalen Attorneys at Law.

(56) References Cited

OTHER PUBLICATIONS

Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Chinese Patent Application No. 201610516097.0, dated Jun. 27, 2017. Translation provided by Unitalen Attorneys at Law.
Office Action regarding Indian Patent Application No. 2043/MUMNP/2011, dated Jul. 28, 2017.
Restriction Requirement regarding U.S. Appl. No. 14/809,786, dated Aug. 16, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys at Law.
Office Action regarding Chinese Patent Application No. 201610512702.7, dated Dec. 20, 2017. Partial translation provided by Unitalen Attorneys at Law.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding Chinese Patent Application No. 201610499158.7, dated Jan. 9, 2018. Translation provided by Unitalen Attorneys at Law.
Office Action regarding U.S. Appl. No. 14/809,786, dated Jan. 11, 2018.
Office Action regarding Chinese Patent Application No. 201580029636.1, dated Jan. 17, 2018. Translation provided by Unitalen Attorneys at Law.
Office Action regarding Chinese Patent Application No. 201580041209.5, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471, dated Feb. 23, 2018.
Office Action regarding Indian Patent Application No. 1907/MUMNP/2012, dated Feb. 26, 2018.
Restriction Requirement regarding U.S. Appl. No. 15/186,092, dated Apr. 3, 2018.
Restriction Requirement regarding U.S. Appl. No. 15/784,458, dated Apr. 5, 2018.
Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Yanagisawa, M.; Uematsu, T.; Hiodoshi, S.; Saito, M.; and Era, S., "Noise Reduction Technology for Inverter Controlled Scroll Compressors" (2002). International Compressor Engineering Conference. Paper 1578.
Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.
Non-Final Office Action for U.S. Appl. No. 18/835,048 dated Nov. 24, 2023.
Office Action regarding Chinese Patent Application No. 201811168307.7, dated Mar. 27, 2020. Translation provided by Unitalen Attorneys at Law.
Office Action regarding Korean Patent Application No. 10-2018-0159231, dated Apr. 7, 2020. Translation provided by Ks Koryo International IP Law Firm.
Office Action regarding Chinese Patent Application No. 201780055443.2, dated Apr. 14, 2020. Translation provided by Unitalen Attorneys at Law.
Notice of Allowance regarding U.S. Appl. No. 15/682,599, dated Apr. 22, 2020.
Notice of Allowance regarding U.S. Appl. No. 15/831,423, dated May 20, 2020.
Notice of Allowance regarding U.S. Appl. No. 15/692,844, dated Jun. 4, 2020.
Restriction Requirement regarding U.S. Appl. No. 16/147,920, dated Jun. 25, 2020.
Office Action regarding U.S. Appl. No. 16/154,406, dated Jun. 29, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Restriction Requirement regarding U.S. Appl. No. 16/154,844, dated Jul. 2, 2020.
Office Action regarding Chinese Patent Application No. 201811480347.5, dated Jul. 21, 2020. Translation provided by Unitalen Attorneys at Law.
Office Action regarding U.S. Appl. No. 15/881,016, dated Jul. 21, 2020.
Office Action regarding U.S. Appl. No. 16/177,902, dated Jul. 23, 2020.
Office Action regarding U.S. Appl. No. 16/147,920, dated Sep. 25, 2020.

(56) References Cited

OTHER PUBLICATIONS

Notice of Allowance regarding U.S. Appl. No. 16/154,406, dated Oct. 2, 2020.
Office Action regarding U.S. Appl. No. 16/154,844, dated Oct. 5, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action mailed Jan. 19, 2023, in U.S. Appl. No. 17/196,119.
Office Action mailed Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
Non-Final Office Action for U.S. Appl. No. 18/115,355 dated Jul. 18, 2023.
International Search Report Regarding Application PCT/US2023/015116-WO-POA Dated Sep. 5, 2023.
International Search Report and Written Opinion in corresponding Application No. PCT/US2022/033029 dated Dec. 6, 2022.
Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Crompressors" (1994). International Compressor Engineering Conference. Paper 1056.
Toyama, T.; Nishikawa, Y.; Yoshida, Y.; Hiodoshi, S.; and Shibamoto, Y., "Reduction of Noise and Over-Compression Loss by Scroll Compressor With Modified Discharge Check Valve" (2002). International Compressor Engineering Conference. Paper 1587.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.
Office Action regarding Korean Patent Application No. 10-2017-7033995, dated Nov. 29, 2018. Translation provided by KS Koryo International IP Law Firm.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.
Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.
Office Action regarding European Patent Application No. 11747996.4, dated Jun. 26, 2019.

(56) References Cited

OTHER PUBLICATIONS

Notice of Allowance regarding U.S. Appl. No. 15/186,151, dated Jul. 25, 2019.
Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.
Office Action regarding Chinese Patent Application No. 201710795228.8, dated Oct. 28, 2019. Translation provided by Unitalen Attorneys at Law.
Office Action regarding European Patent Application No. 11747996.4, dated Nov. 5, 2019.
Notice of Allowance regarding U.S. Patent Application No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Office Action regarding U.S. Appl. No. 15/831,423, dated Jan. 31, 2020.
Notice of Allowance regarding U.S. Appl. No. 15/692,844, dated Feb. 20, 2020.
Office Action regarding European Patent Application No. 13859308.2, dated Mar. 4, 2020.
Luckevich, Mark, "MEMS microvalves: the new valve world." Valve World, May 2007, pp. 79-83.
Office Action regarding U.S. Appl. No. 11/522,250, dated Aug. 1, 2007.
Search Report regarding European Patent Application No. 07254962.9, dated Mar. 12, 2008.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 11/645,288, dated Nov. 30, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Chinese Patent Application No. 200710160038.5, dated Jul. 8, 2010. Translation provided by Unitalen Attorneys at Law.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
International Search Report regarding International Application No. PCT/US2010/030248, dated Nov. 26, 2010.
Written Opinion of the International Searching Authority regarding International Application No. PCT/US2010/030248, dated Nov. 26, 2010.
International Search Report regarding International Application No. PCT/US2011/025921, dated Oct. 7, 2011.
Written Opinion of the International Search Authority regarding International Application No. PCT/US2011/025921, dated Oct. 7, 2011.
Office Action regarding Chinese Patent Application No. 200710160038.5, dated Jan. 31, 2012. Translation provided by Unitalen Attorneys at Law.
Office Action regarding Chinese Patent Application No. 201010224582.3, dated Apr. 17, 2012. Translation provided by Unitalen Attorneys at Law.
Office Action regarding Indian Patent Application No. 1071/KOL/2007, dated Apr. 27, 2012.
Office Action regarding U.S. Appl. No. 13/036,529, dated Aug. 22, 2012.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding Chinese Patent Application No. 201080020243.1, dated Nov. 5, 2013. Translation provided by Unitalen Attorneys at Law.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
Office Action regarding Chinese Patent Application No. 201180010366.1, dated Jun. 4, 2014. Translation provided by Unitalen Attorneys at Law.
Office Action regarding Chinese Patent Application No. 201180010366.1, dated Dec. 31, 2014. Translation provided by Unitalen Attorneys at Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.

(56) References Cited

OTHER PUBLICATIONS

Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
International Search Report regarding International Application No. PCT/US2015/042479, dated Oct. 23, 2015.
Written Opinion of the International Searching Authority regarding International Application No. PCT/US2015/042479, dated Oct. 23, 2015.
Office Action regarding Chinese Patent Application No. 201410461048.2, dated Nov. 30, 2015. Translation provided by Unitalen Attorneys at Law.
Notice of Allowance regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.
Office Action regarding Chinese Patent Application No. 201380059666.8, dated Apr. 5, 2016. Translation provided by Unitalen Attorneys at Law.
Office Action regarding Chinese Patent Application No. 201380062614.6, dated Apr. 5, 2016. Translation provided by Unitalen Attorneys at Law.
Non-Final Office Action regarding U.S. Appl. No. 18/394,474 dated Apr. 11, 2024.
International Search Report and Written Opinion regarding Application No. PCT/US2023/086010 dated Apr. 24, 2024.
Final Office Action regarding U.S. Appl. No. 17/835,048 dated May 3, 2024.
Non-Final Office Action regarding U.S. Appl. No. 18/381,884 dated May 10, 2024.

* cited by examiner

Heating Mode, Intermediate-Capacity Mode

Heating Mode, Low-Capacity Mode

Cooling Mode, Intermediate-Capacity Mode

Cooling Mode, Low-Capacity Mode

HEAT PUMP SYSTEMS WITH CAPACITY MODULATION

FIELD

The present disclosure relates to heat pump systems with capacity modulation.

BACKGROUND

This section provides background information related to the present disclosure and is not necessarily prior art.

A climate-control system such as, for example, a heat pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

In one form, the present disclosure provides a compressor that may include a first scroll, a second scroll, and a capacity modulation assembly. The first scroll may include a first end plate and a first spiral wrap extending from the first end plate. The second scroll may include a second end plate and a second spiral wrap extending from the second end plate. The first and second spiral wraps mesh with each other to form a plurality of pockets therebetween. The pockets include a radially outer pocket, a radially inner pocket, and an intermediate pocket disposed radially between the radially outer and inner pockets. The capacity modulation assembly may be operable in a first capacity mode and a second capacity mode. The capacity modulation assembly may include a valve ring and a modulation control valve. The valve ring is movable relative to the first scroll between a first position corresponding to the first capacity mode and a second position corresponding to the second capacity mode. The modulation control valve includes a valve body and a valve member that is movable relative to the valve body to cause corresponding movement of the valve ring between the first and second positions. The valve body includes a cavity in which the valve member is movably disposed. The valve body includes passages in fluid communication with the cavity. A first pressure differential between fluid in one of the passages and fluid in another of the passages causes movement of the valve member to cause corresponding movement of the valve ring from the first position to the second position. A second pressure differential between fluid in the one of the passages and fluid in the other of the passages causes movement of the valve member to cause corresponding movement of the valve ring from the second position to the first position.

In some configurations of the compressor of the above paragraph, the passages of the valve body include: a first passage, a second passage, a third passage, a fourth passage, and a fifth passage.

In some configurations of the compressor of either of the above paragraphs, the first passage is in fluid communication with an axial biasing chamber. The axial biasing chamber may be defined by a floating seal assembly and the valve ring.

In some configurations of the compressor of any one or more of the above paragraphs, the second passage is in fluid communication with a modulation chamber defined by the valve ring.

In some configurations of the compressor of any one or more of the above paragraphs, the third and fifth passages are in fluid communication with a suction chamber of the compressor.

In some configurations of the compressor of any one or more of the above paragraphs, the fourth passage is fluidly connected to a conduit that extends out of the compressor.

In some configurations of the compressor of any one or more of the above paragraphs, the valve member includes a main body and a stem. The stem may extend from the main body and may be narrower than the main body.

In some configurations of the compressor of any one or more of the above paragraphs, the main body includes a cutout that is in fluid communication with the second passage and the cavity of the valve body.

In some configurations of the compressor of any one or more of the above paragraphs, the cavity is in selective fluid communication with the first passage and is in selective fluid communication with the third passage.

In some configurations of the compressor of any one or more of the above paragraphs, the stem is received in the fourth passage when the cavity is in fluid communication with the first and second passages.

In some configurations of the compressor of any one or more of the above paragraphs, the conduit may extend through a shell assembly in which the first and second scrolls are housed.

In another form, the present disclosure provides a compressor including first and second scrolls and a capacity modulation assembly. The first scroll includes a first end plate and a first spiral wrap extending from the first end plate. The second scroll includes a second end plate and a second spiral wrap extending from the second end plate. The first and second spiral wraps mesh with each other and forming a plurality of pockets therebetween. The pockets include a radially outer pocket, a radially inner pocket, and an intermediate pocket disposed radially between the radially outer and inner pockets. The capacity modulation assembly is operable in a first capacity mode and a second capacity mode, wherein the capacity modulation assembly includes a valve ring and a modulation control valve. The valve ring is movable relative to the first scroll between a first position corresponding to the first capacity mode and a second position corresponding to the second capacity mode. The valve ring cooperates with a floating seal assembly to define an axial biasing chamber. Movement of the modulation control valve causes corresponding movement of the valve ring and switches the compressor between the first and second capacity modes. The modulation control valve includes a valve body and a valve member disposed within the valve body and movable relative to the valve body. The valve body includes a first passage, a second passage, a third passage, a fourth passage, and a fifth passage. The first passage is in fluid communication with the axial biasing chamber. The second passage is in fluid communication with a modulation chamber defined by the valve ring. The third and fifth passages are in fluid communication with a suction chamber of the compressor. The fourth passage is fluidly connected to a conduit that extends out of the compressor.

In some configurations of the compressor of the above paragraph, the valve member includes a main body and a stem. The stem extends from the main body and is narrower than the main body.

In some configurations of the compressor of either of the above paragraphs, the main body includes a cutout that is in fluid communication with the second passage and a cavity of the valve body, wherein the valve member is movably disposed within the cavity.

In some configurations of the compressor of any one or more of the above paragraphs, the cavity is in selective fluid communication with the first passage and is in selective fluid communication with the third passage.

In some configurations of the compressor of any one or more of the above paragraphs, the stem is received in the fourth passage when the cavity is in fluid communication with the first and second passages.

In some configurations of the compressor of any one or more of the above paragraphs, the conduit extends through a shell assembly in which the first and second scrolls are housed.

In another form, the present disclosure provides a compressor including first and second scrolls and a capacity modulation assembly. The first scroll includes a first end plate and a first spiral wrap extending from the first end plate. The second scroll includes a second end plate and a second spiral wrap extending from the second end plate. The first and second spiral wraps mesh with each other and forming a plurality of pockets therebetween. The pockets include a radially outer pocket, a radially inner pocket, and an intermediate pocket disposed radially between the radially outer and inner pockets. The capacity modulation assembly is operable in a first capacity mode and a second capacity mode. The capacity modulation assembly may include a valve ring and a modulation control valve. The valve ring is movable relative to the first scroll between a first position corresponding to the first capacity mode and a second position corresponding to the second capacity mode. The valve ring defines an axial biasing chamber and a modulation chamber. A pressure differential between fluid in the axial biasing chamber and fluid in the modulation chamber causes movement of the valve ring relative to the first scroll. The modulation control valve includes a valve member that is movable to cause corresponding movement of the valve ring. Fluid from first and second sources exert first and second forces, respectively, on the valve member. A differential between the first and second forces moves the valve member to cause corresponding movement of the valve ring.

In some configurations of the compressor of the above paragraph, the modulation control valve includes a valve body in which the valve member is movably disposed. The valve body includes a first passage, a second passage, a third passage, a fourth passage, and a fifth passage.

In some configurations of the compressor of either of the above paragraphs, the first passage is in fluid communication with the axial biasing chamber.

In some configurations of the compressor of any one or more of the above paragraphs, the second passage is in fluid communication with a modulation chamber defined by the valve ring.

In some configurations of the compressor of any one or more of the above paragraphs, the third and fifth passages are in fluid communication with a suction chamber of the compressor.

In some configurations of the compressor of any one or more of the above paragraphs, the fourth passage is fluidly connected to a conduit that extends out of the compressor.

In some configurations of the compressor of any one or more of the above paragraphs, the valve member includes a main body and a stem. The stem extends from the main body and is narrower than the main body.

In some configurations of the compressor of any one or more of the above paragraphs, the main body includes a cutout that is in fluid communication with the second passage and a cavity of the valve body. The valve member is movably disposed within the cavity.

In some configurations of the compressor of any one or more of the above paragraphs, the cavity is in selective fluid communication with the first passage and is in selective fluid communication with the third passage.

In some configurations of the compressor of any one or more of the above paragraphs, the stem is received in the fourth passage when the cavity is in fluid communication with the first and second passages.

In some configurations of the compressor of any one or more of the above paragraphs, the conduit extends through a shell assembly in which the first and second scrolls are housed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
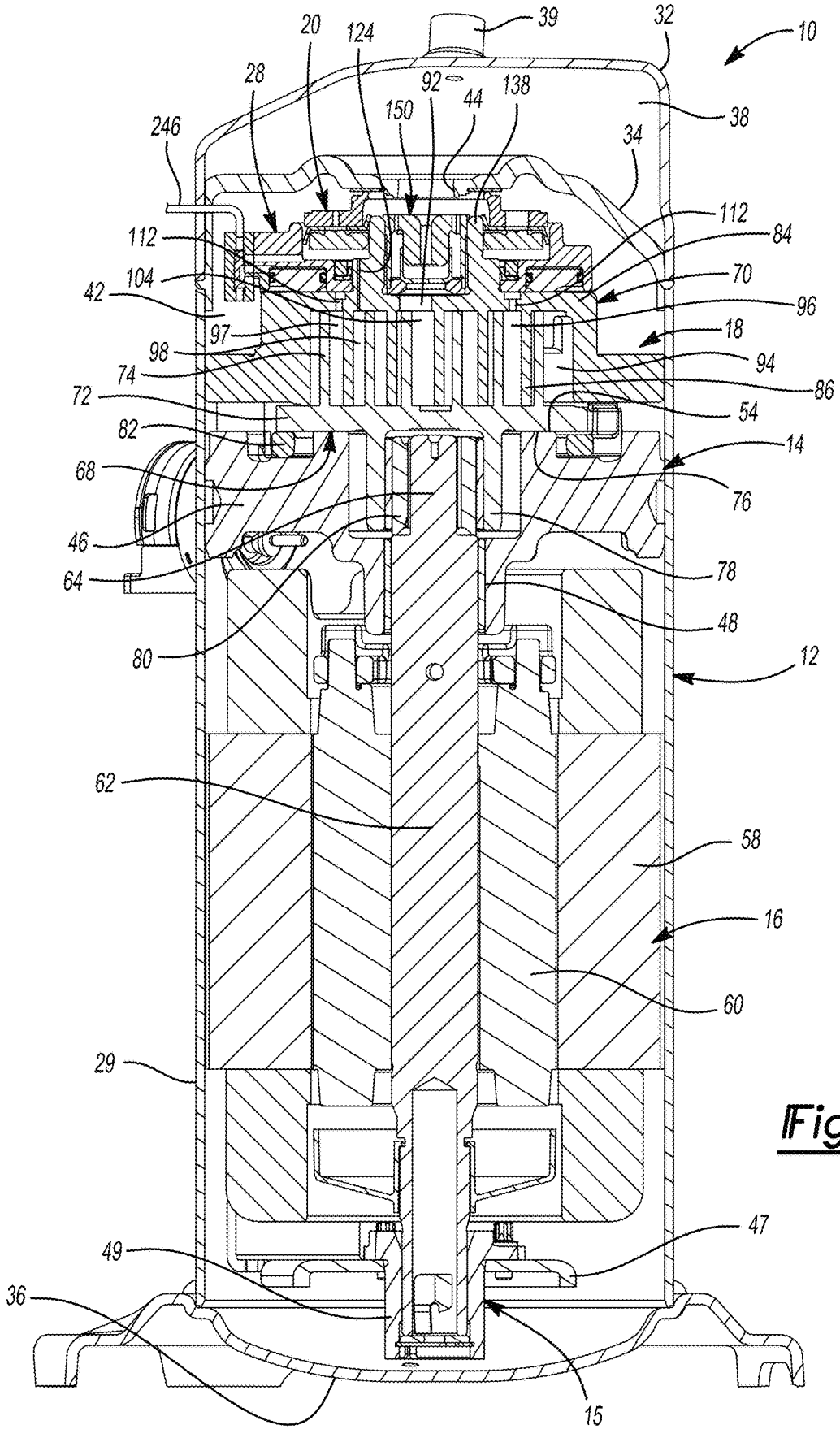
FIG. 1 is a cross-sectional view of a compressor having a capacity-modulation assembly according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing housing assembly 14, a second bearing housing assembly 15, a motor assembly 16, a compression mechanism 18, a floating seal assembly 20, and a capacity modulation assembly 28. The shell assembly 12 may house the bearing housing assemblies 14, 15, the motor assembly 16, the compression mechanism 18, the seal assembly 20, and the capacity modulation assembly 28.

The shell assembly 12 forms a compressor housing and may include a cylindrical shell 29, an end cap 32 at the upper end thereof, a transversely extending partition 34, and a base 36 at a lower end thereof. The end cap 32 and partition 34 may generally define a discharge-pressure chamber 38. The discharge-pressure chamber 38 may generally form a discharge muffler for compressor 10. While the compressor 10 is illustrated as including the discharge-pressure chamber 38, the present disclosure applies equally to direct discharge configurations. A discharge fitting 39 may be attached to the shell assembly 12 at an opening in the end cap 32. A suction-gas-inlet fitting 40 (shown schematically in FIG. 5) may be attached to the shell assembly 12 at another opening. The partition 34, the shell 29, and the base 36 may define a suction-pressure chamber 42 that receives suction-pressure working fluid from the suction-gas-inlet fitting 40. The partition 34 and the floating seal assembly 20 may separate the suction-pressure chamber 42 from the discharge-pressure chamber 38. The partition 34 may include a discharge passage 44 therethrough providing communication between the compression mechanism 18 and the discharge-pressure chamber 38.

The first bearing housing assembly 14 may be affixed to the shell 29 and may include a main bearing housing 46 and a first bearing 48 disposed therein. The main bearing housing 46 may house the bearing 48 therein and may define an annular flat thrust bearing surface 54 on an axial end surface thereof. The second bearing housing assembly 15 may be affixed to the shell 29 and may include a lower bearing housing 47 and a second bearing 49 disposed therein.

The motor assembly 16 may generally include a motor stator 58, a rotor 60, and a driveshaft 62. The motor stator 58 may be press fit into the shell 29. The driveshaft 62 may be rotatably driven by the rotor 60 and may be rotatably supported within the bearing 48. The rotor 60 may be press fit on the driveshaft 62. The driveshaft 62 may include an eccentric crankpin 64.

The compression mechanism 18 may include a first scroll (e.g., an orbiting scroll 68) and a second scroll (e.g., a non-orbiting scroll 70). The orbiting scroll 68 may include an end plate 72 having a spiral wrap 74 on the upper surface thereof and an annular flat thrust surface 76 on the lower surface. The thrust surface 76 may interface with the annular flat thrust bearing surface 54 on the main bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. A flat surface of the crankpin 64 may drivingly engage a flat surface in a portion of the inner bore of the drive bushing 80 to provide a radially compliant driving arrangement. An Oldham coupling 82 may be engaged with the orbiting and non-orbiting scrolls 68, 70 or the orbiting scroll 68 and the main bearing housing 46 to prevent relative rotation therebetween.

Figure 2:
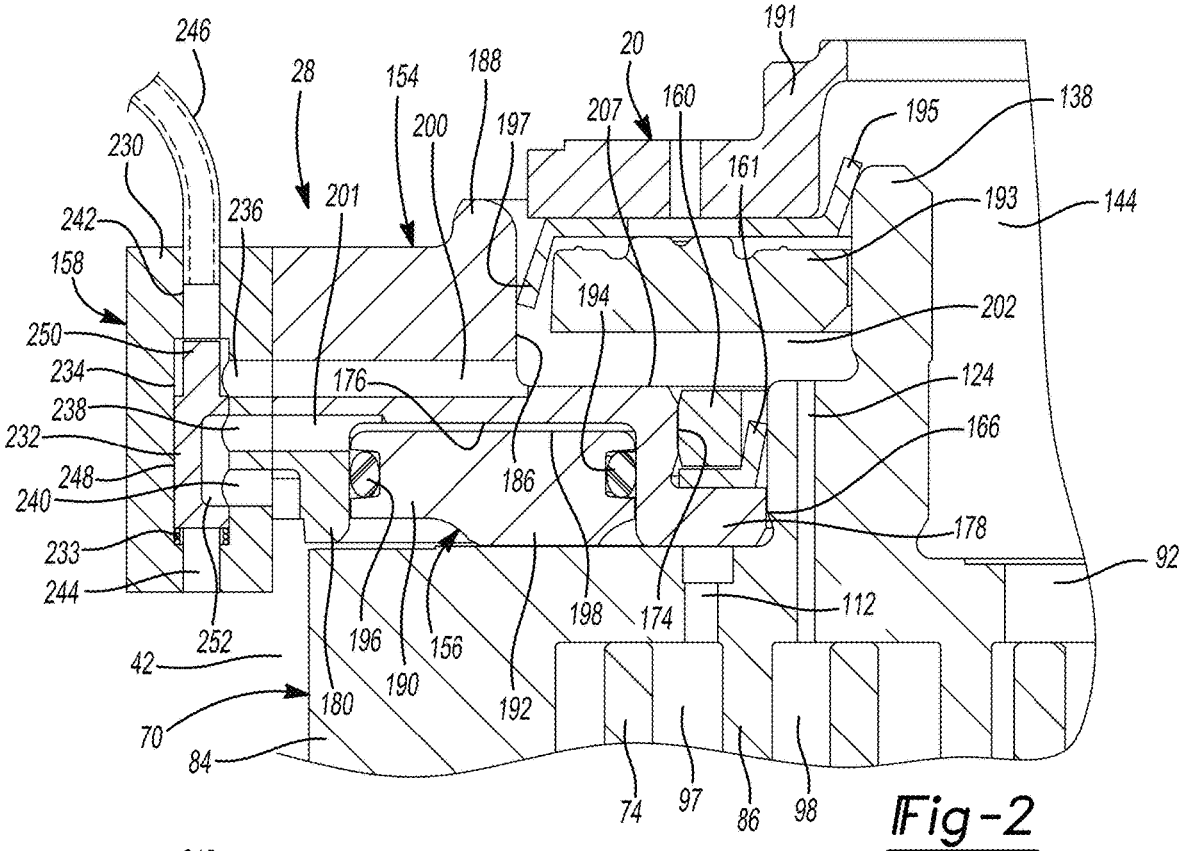
FIG. 2 is a partial cross-sectional view of a scroll and the capacity-modulation assembly of the compressor of FIG. 1, wherein the capacity-modulation assembly is in a full-capacity position.
Figure 3:
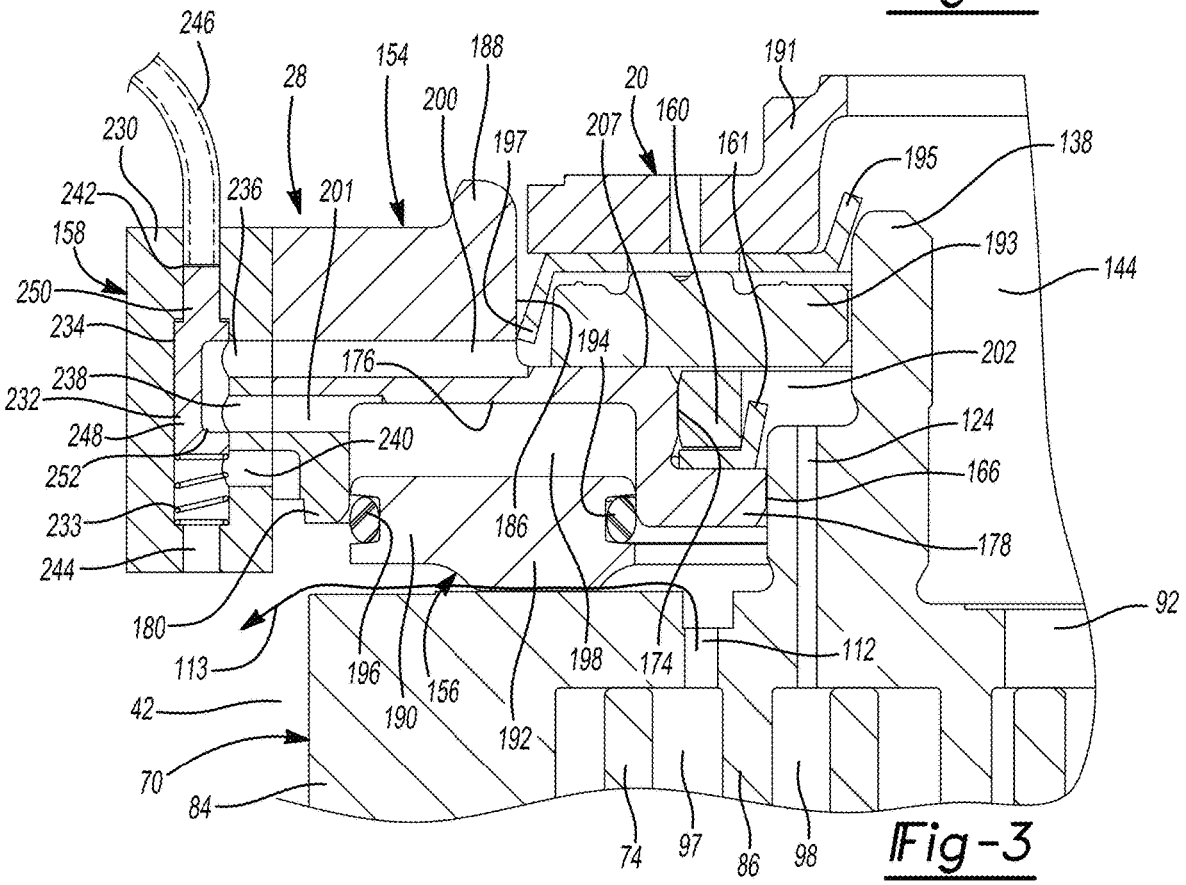
FIG. 3 is a partial cross-sectional view of the scroll and the capacity-modulation assembly in a reduced-capacity position.

As shown in FIGS. 1-3, the non-orbiting scroll 70 may include an end plate 84 defining a discharge passage 92 and having a spiral wrap 86 extending from a first side thereof. The non-orbiting scroll 70 may be attached to the bearing housing 46 via fasteners and sleeve guides that allow for a limited amount of axial movement of the non-orbiting scroll 70 relative to the orbiting scroll 68 and the bearing housing 46. The spiral wraps 74, 86 may be meshingly engaged with one another and define pockets 94, 96, 97, 98, 104. It is understood that the pockets 94, 96, 97, 98, 104 change throughout compressor operation.

A first pocket (e.g., pocket 94 in FIG. 1) may define a suction pocket in communication with a suction-pressure region (e.g., the suction-pressure chamber 42) of the compressor 10 operating at a suction pressure. A second pocket (e.g., pocket 104 in FIG. 1) may define a discharge pocket in communication with a discharge pressure region (e.g., discharge chamber 38 receiving discharge-pressure working fluid from the compression mechanism 18) of the compressor 10 operating at a discharge pressure via the discharge passage 92. Pockets intermediate the first and second pockets (e.g., pockets 96, 97, 98 in FIG. 1) may form intermediate compression pockets operating at intermediate pressures between the suction pressure and the discharge pressure.

As shown in FIGS. 1-3, the end plate 84 of the non-orbiting scroll 70 may include one or more modulation passages or ports 112 and one or more intermediate-cavity-pressure (ICP) passages or ports 124. The modulation ports 112 may extend entirely through first and second opposing axially facing sides of the end plate 84 and are in selective fluid communication with respective intermediate pressure pockets (e.g., pockets 96, 97). The ICP port 124 may be in selective fluid communication with another intermediate pressure pocket (e.g., pocket 98). The modulation ports 112 may be disposed radially outward relative to the ICP port 124.

The end plate 84 of the non-orbiting scroll 70 may include a hub 138 that extends away from the spiral wraps 74, 86. A discharge passage 144 (FIGS. 2 and 3) extends axially through the hub 138 and is in fluid communication with the discharge chamber 38 via the discharge passage 44 in the partition 34. The discharge passage 144 is also in selective fluid communication with the discharge passage 92 in the end plate 84.

Figure 4:
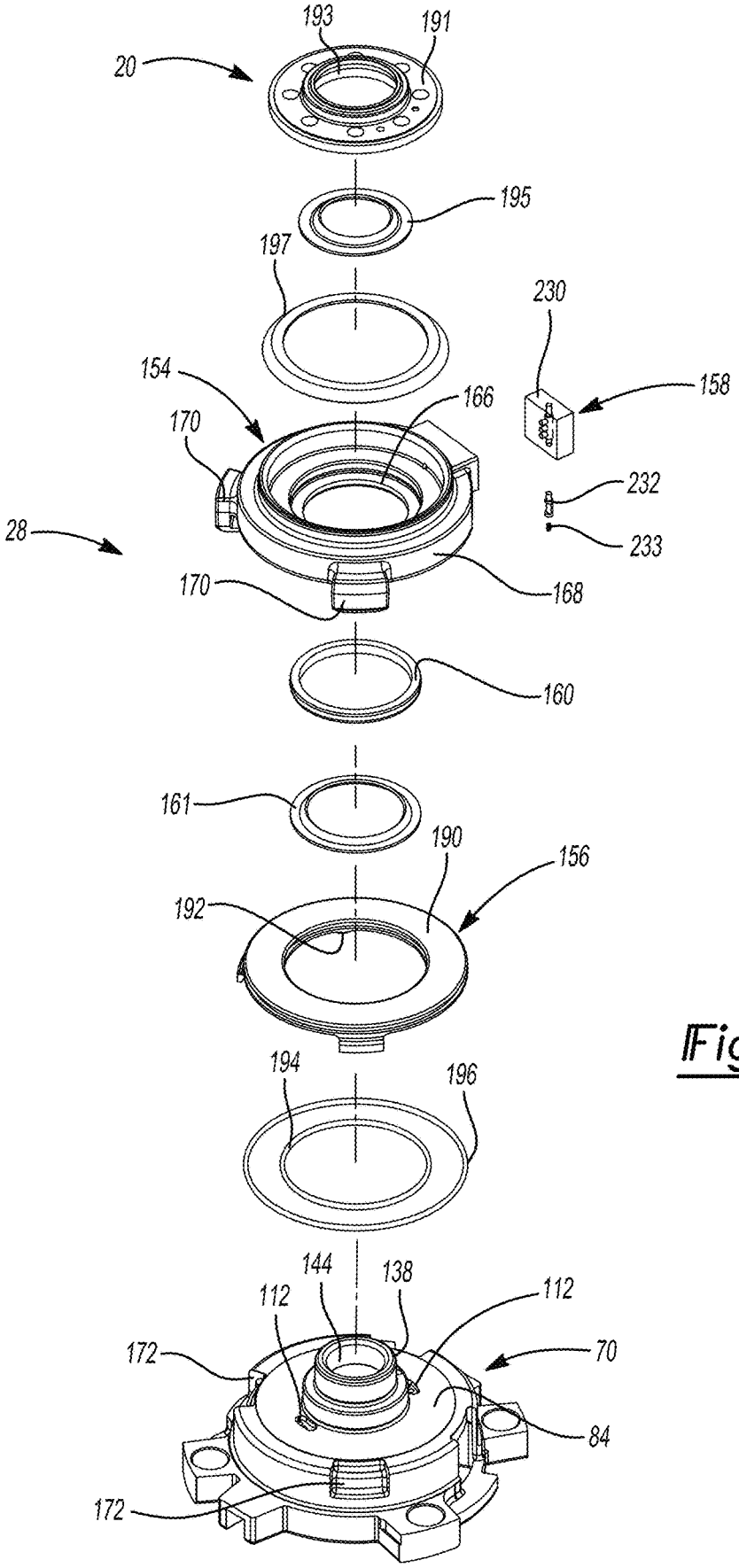
FIG. 4 is an exploded view of the scroll and capacity modulation assembly.

As shown in FIG. 4, a discharge valve assembly 150 (FIG. 1) may also be disposed within the discharge passage 144 of the hub 138. The discharge valve assembly 150 may be a one-way valve that allows fluid flow from the discharge passage 92 to the discharge chamber 38 and restricts or prevents fluid flow from the discharge chamber 38 back into the compression mechanism 18.

As shown in FIGS. 2-4, the capacity modulation assembly 28 may include a valve ring 154, a lift ring 156, and a modulation control valve 158. As will be described in more detail below, the capacity modulation assembly 28 is operable to switch the compressor 10 between a first capacity mode (e.g., a full-capacity or high-capacity mode; shown in FIG. 2) and a second capacity mode (e.g., a reduced-capacity or low-capacity mode; shown in FIG. 3). In the full-capacity mode, fluid communication between the modulation ports 112 and the suction-pressure chamber 42 is prevented. In the reduced-capacity mode, the modulation ports 112 are allowed to fluidly communicate with the suction-pressure chamber 42 to vent intermediate-pressure working fluid from intermediate compression pockets (e.g., pockets 96, 97) to the suction-pressure chamber 42.

As shown in FIGS. 2-4, the valve ring 154 may be an annular body having a stepped central opening 166 extending therethrough and through which the hub 138 extends. In other words, the valve ring 154 encircles the hub 138 of the non-orbiting scroll 70. As shown in FIG. 4, the valve ring 154 may include an outer peripheral surface 168 having a plurality of key features 170 (e.g., generally rectangular blocks) that extend radially outward and axially downward from the outer peripheral surface 168. The key features 170 may be slidably received in keyways 172 (e.g., generally rectangular recesses; shown in FIG. 4) formed in the outer periphery of the end plate 84. The key features 170 and keyways 172 allow for axial movement of the valve ring 154 relative to the non-orbiting scroll 70 while restricting or preventing rotation of the valve ring 154 relative to the non-orbiting scroll 70.

As shown in FIGS. 2 and 3, the central opening 166 of the valve ring 154 is defined by a plurality of steps in the valve ring 154 that form a plurality of annular recesses. For instance, a first annular recess 174 may be formed proximate a lower axial end of the valve ring 154 and may receive a seal ring 160. The seal ring 160 sealingly engages the valve ring 154 and the hub 138 of the non-orbiting scroll 70. The seal ring 160 may include an annular lip seal 161 that may facilitate sealing engagement among the seal ring 160, valve ring 154 and the hub 138. A second annular recess 176 may encircle the first annular recess 174 and may be defined by inner and outer lower annular rims 178, 180 of the valve ring 154. The lift ring 156 is partially received in the second annular recess 176. A third annular recess 186 may be disposed axially above the first and second annular recesses 174, 176 and may be defined by an axially upper rim 188 of the valve ring 154. The third annular recess 186 may receive a portion of the floating seal assembly 20.

As will be described in more detail below, the valve ring 154 is movable in an axial direction (i.e., a direction along or parallel to a rotational axis of the driveshaft 62) relative to the end plate 84 between a first position (FIG. 2) and a second position (FIG. 3). In the first position (FIG. 2), the inner rim 178 of the valve ring 154 contacts the end plate 84 and closes off the modulation ports 112 to prevent fluid communication between the modulation ports 112 and the suction-pressure chamber 42. In the second position (FIG. 3), the inner rim 178 of the valve ring 154 is spaced apart from the end plate 84 to open the modulation ports 112 to allow fluid communication between the modulation ports 112 and the suction-pressure chamber 42.

As shown in FIGS. 2-4, the lift ring 156 may include an annular body 190 and a plurality of posts or protrusions 192 (FIG. 4) extending axially downward from the body 190. As shown in FIGS. 2 and 3, the annular body 190 may be received within the second annular recess 176 of the valve ring 154. The annular body 190 may include inner and outer annular seals (e.g., O-rings) 194, 196. The inner annular seal 194 may sealingly engage an inner diametrical surface of the annular body 190 and the inner lower rim 178 of the valve ring 154. The outer annular seal 196 may sealingly engage an outer diametrical surface of the annular body 190 and the outer lower rim 180 of the valve ring 154. The protrusions 192 may contact the end plate 84 and axially separate the annular body 190 from the end plate 84. The lift ring 156 remains stationary relative to the end plate 84 while the valve ring 154 and seal ring 160 move axially relative to the end plate 84 between the first and second positions (see FIGS. 2 and 3).

As shown in FIGS. 2 and 3, the annular body 190 of the lift ring 156 may cooperate with the valve ring 154 to define a modulation control chamber 198. That is, the modulation control chamber 198 is defined by and disposed axially between opposing axially facing surfaces of the annular body 190 and the valve ring 154. The valve ring 154 includes a first control passage 200 and a second control passage 201. The first control passage 200 may extend from the third annular recess 186 to the modulation control valve 158. The second control passage 201 extends from the modulation control chamber 198 to the modulation control valve 158 (i.e., the second control passage 201 fluidly communicates with the modulation control chamber 198 and the modulation control valve 158).

As shown in FIGS. 2 and 3, the floating seal assembly 20 may be an annular member encircling the hub 138. For example, the floating seal assembly 20 may include first and second annular disks 191, 193 that are fixed to each other and annular lip seals 195, 197 that extend from the disks 191, 193. The floating seal assembly 20 may be sealingly engaged with the partition 34, the hub 138, and the valve ring 154. In this manner, the floating seal assembly 20 fluidly separates the suction-pressure chamber 42 from the discharge-pressure chamber 38. In some configurations, the floating seal assembly 20 could be a one-piece floating seal.

During steady-state operation of the compressor 10, the floating seal assembly 20 may be a stationary component. The floating seal assembly 20 is partially received in the third annular recess 186 of the valve ring 154 and cooperates with the hub 138 and the valve ring 154 to define an axial biasing chamber 202 (FIGS. 2 and 3). The axial biasing chamber 202 is axially between and defined by the floating seal assembly 20 and an axially facing surface 207 of the valve ring 154. The first control passage 200 of the valve ring 154 may extend from the axial biasing chamber 202 to the modulation control valve 158. The first control passage 200 fluidly communicates with the axial biasing chamber 202 and the modulation control valve 158.

The axial biasing chamber 202 is in fluid communication with the ICP port 124 (FIGS. 2 and 3). The ICP port 124 provides intermediate-pressure working fluid to the axial biasing chamber 202 (supplied by, for example, the intermediate-pressure pocket 98) biases the non-orbiting scroll 70 in an axial direction (a direction along or parallel to the rotational axis of the driveshaft 62) toward the orbiting scroll 68 to provide proper axial sealing between the scrolls 68, 70 (i.e., sealing between tips of the spiral wrap 74 of the orbiting scroll 68 against the end plate 84 of the non-orbiting scroll 70 and sealing between tips of the spiral wrap 86 of the non-orbiting scroll 70 against the end plate 72 of the orbiting scroll 68).

The modulation control valve 158 may be a solenoid-operated multiway valve and may be in fluid communication with the suction-pressure chamber 42, the first and second control passages 200, 201, and the ICP port 124. During operation of the compressor 10, the modulation control valve 158 may be operable to switch the compressor 10 between a first mode (e.g., the full-capacity mode) and a second mode (e.g., the reduced-capacity mode).

When the compressor 10 is in the full-capacity mode (FIG. 2), the modulation control valve 158 may provide fluid communication between the modulation control chamber 198 and the suction-pressure region 106 via the second control passage 201, thereby lowering the fluid pressure within the modulation control chamber 198 to suction pressure. With the fluid pressure within the modulation control chamber 198 at or near suction pressure, the relatively higher fluid pressure within the axial biasing chamber 202 (e.g., an intermediate pressure) will force the valve ring 154 axially downward relative to the end plate 84 (i.e., away from the floating seal assembly 20) such that the valve ring 154 is in contact with the end plate 84 and closes the modulation ports 112 (i.e., to prevent fluid communication between the modulation ports 112 and the suction-pressure chamber 42), as shown in FIG. 2.

When the compressor 10 is in the reduced-capacity mode (FIG. 3), the modulation control valve 158 may provide fluid communication between the modulation control chamber 198 and the axial biasing chamber 202 via the first and second control passages 200, 201, thereby raising the fluid pressure within the modulation control chamber 198 to the same or similar intermediate pressure as the axial biasing chamber 202. With the fluid pressure within the modulation control chamber 198 at the same intermediate pressure as the axial biasing chamber 202, the fluid pressure within the modulation control chamber 198 and the fluid pressure in the modulation ports 112 will force the valve ring 154 axially upward relative to the end plate 84 (i.e., toward the floating seal assembly 20) such that the valve ring 154 is spaced apart from the end plate 84 to open the modulation ports 112 (i.e., to allow fluid communication between the modulation ports 112 and the suction-pressure chamber 42), as shown in FIG. 3.

As shown in FIGS. 2 and 3, the modulation control valve 158 may include a valve body 230, a valve member 232, and a biasing member (e.g., a coil spring) 233. The valve member 232 is movable relative to the valve body 230 between a first position (FIG. 2) and a second position (FIG. 3). As will be described in more detail below, movement of the valve member 232 into the first position switches the compressor 10 into the full-capacity mode (FIG. 2) and prevents fluid communication between the modulation ports 112 and the suction-pressure chamber 42. Movement of the valve member 232 into the second position switches the compressor 10 into the reduced-capacity mode (FIG. 3) and allows fluid communication between the modulation ports 112 and the suction-pressure chamber 42.

As shown in FIGS. 2 and 3, the valve body 230 may include an internal cavity 234, a first passage 236, a second passage 238, a third passage 240, a fourth passage 242, and a fifth passage 244. The first, second, third, fourth, and fifth passages 236, 238, 240, 242, 244 are in fluid communication with the internal cavity 234. The valve body 230 may be mounted to the valve ring 154 such that the first and second passages 236, 238 of the valve body 230 are aligned with and in fluid communication with the first and second control passages 200, 201, respectively. That is, the first passage 236 may be aligned with and in fluid communication with the first control passage 200, and the second passage 238 may be aligned with and in fluid communication with the second control passage 201. The third and fifth passages 240, 244 of the valve body 230 may be in fluid communication with the suction-pressure chamber 42. The fourth passage 242 of the valve body 230 may be fluidly connected with a conduit 246. As will be described in more detail below, the conduit 246 selectively provides high-pressure working fluid (e.g., discharge-pressure working fluid or working fluid at a pressure higher than suction pressure) to the fourth passage 244 to control movement of the valve member 232 within the valve body 230. The conduit 246 may extend from the valve body 230 and through the shell assembly 12 of the compressor 10. The conduit 246 (or at least a portion of the conduit 246 that is attached to the valve body 230) may be flexible to accommodate movement of the valve body 230 with the valve ring 154 (i.e., when the valve ring 154 moves between the first and second positions.

The valve member 232 may include a main body 248 and a stem 250. The stem 250 has a smaller width or diameter than the main body 248. The valve member 232 is disposed within the internal cavity 234 and is movable therein between the first position (FIG. 2) and the second position (FIG. 3). The stem 250 of the valve member 232 may be reciprocatingly received in the fourth passage 242 of the valve body 230. A cutout 252 may be formed in the main body 248 of the valve member 232. The cutout 252 is open to (in fluid communication with) the internal cavity 234. When the valve member 232 is in the first position (FIG. 2), the cutout 252 is in fluid communication with the second and third passages 238, 240 of the valve body 230 to allow fluid communication between the modulation control chamber 198 and the suction-pressure chamber 42 (via the second control passage 201 in the valve ring 154) while preventing fluid communication between the first control passage 200 and the second control passage 201). When the valve member 232 is in the second position (FIG. 3), the cutout 252 is in fluid communication with the first and second passages 236, 238 of the valve body 230 to allow fluid communication between the modulation control chamber 198 and the axial biasing chamber 202 (via the first and second control passages 200, 201 in the valve ring 154) while preventing fluid communication between the second control passage 201 and the suction-pressure chamber 42). As shown in FIGS. 2 and 3, the first control passage 200 is prevented from fluidly communicating with the suction-pressure chamber 42 in both of the cooling and heating modes.

The biasing member 233 may be a coil spring and may be disposed within the internal cavity 234 of the valve body 230. The biasing member 233 may be disposed between a ledge in the valve body 230 and an end of the valve member 232. The biasing member 233 biases the valve member 232 toward the second position (FIG. 3).

Figure 5:
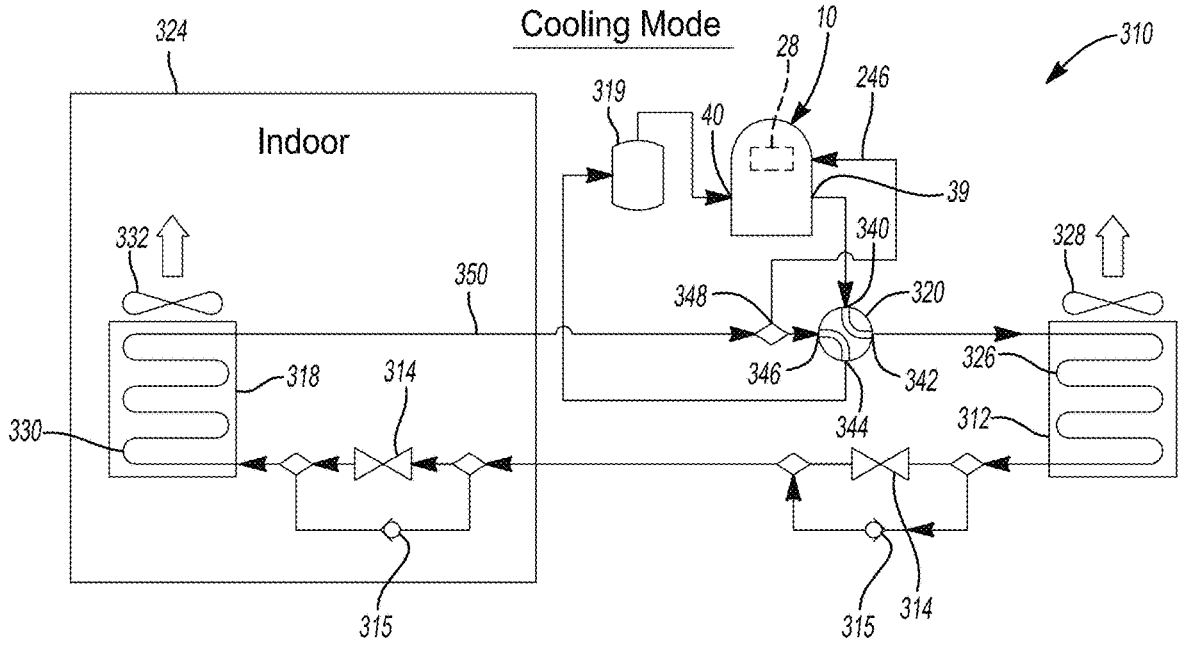
FIG. 5 is a schematic representation of a climate-control system including the compressor of FIG. 1, wherein the climate-control system is operating in a cooling mode.
Figure 6:
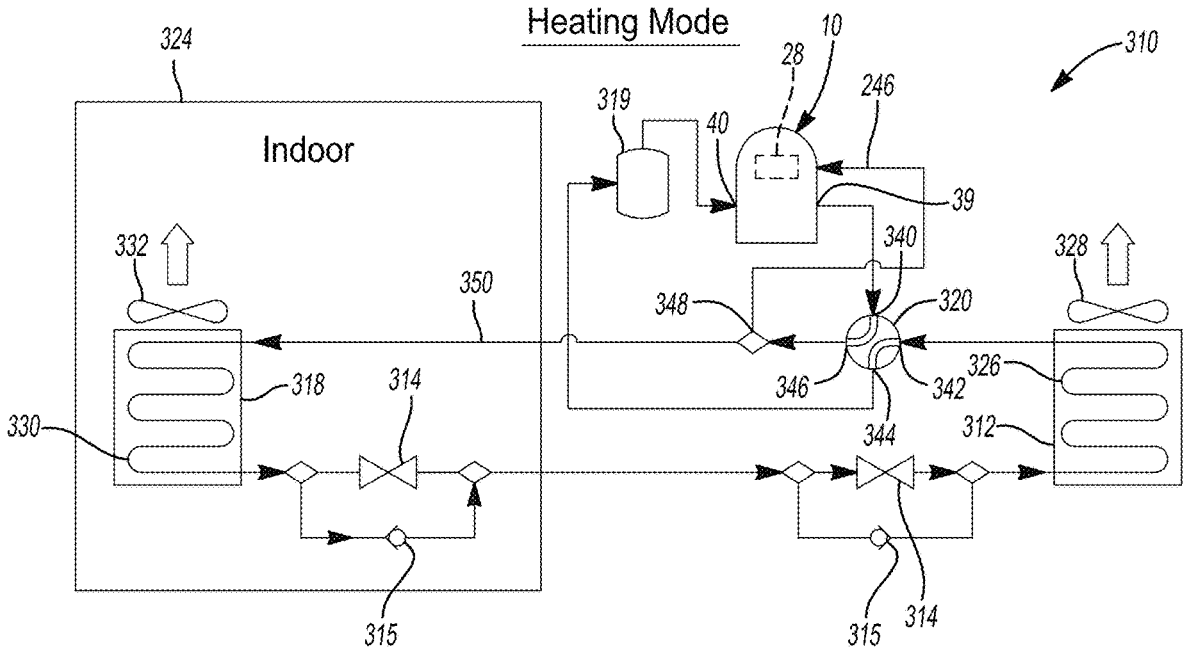
FIG. 6 is a schematic representation of the climate-control system of FIG. 5 operating in a heating mode.

Referring now to FIGS. 5 and 6, a climate-control system (e.g., a heat pump system) 310 is provided. The climate-control system 310 may include the compressor 10 (i.e., the compressor 10 described above with reference to FIGS. 1-4), an outdoor heat exchanger 312, one or more expansion devices 314, an indoor heat exchanger 318, an accumulator 319, and a multiway valve (reversing valve) 320. The indoor heat exchanger 318 may be disposed indoors (i.e., inside of a home or building 324), and the compressor 10 and outdoor heat exchanger 312 may be disposed outdoors (i.e., outside of the home or building 324). The expansion device(s) 314 and the valve 320 may be disposed outdoors or indoors.

The climate-control system 310 may be operable in a cooling mode (FIG. 5) and in a heating mode (FIG. 6). In the heating and cooling modes, the compressor 10 may pump the working fluid (e.g., a refrigerant, for example) through the climate-control system 310 in the heating and cooling modes. Working fluid may be received through the suction-gas-inlet fitting 40 of the compressor 10 and is compressed by the compression mechanism 18. Discharge-pressure working fluid is discharged from the compressor 10 through the discharge fitting 39.

The outdoor heat exchanger 312 may include a coil 326 (or conduit). A fan 328 may force air across the coil 326 to facilitate heat transfer between outdoor ambient air and working fluid flowing through the coil 326. The indoor heat exchanger 318 may include a coil 330 and a fan 332 may force air across the coil 330 to facilitate heat transfer between indoor air and working fluid flowing through the coil 330. The expansion device 314 may be an expansion valve or a capillary tube, for example. In configurations of the system 310 having two expansion devices 314, one of the expansion devices 314 may be closed in the cooling mode (a check valve 315 allows working fluid to bypass the closed expansion device 314 in the cooling mode) and open in the heating mode, and the other of the expansion devices 314 may be open in the cooling mode and closed in the heating mode (another check valve 315 allows working fluid to bypass the closed expansion device 314 in the heating mode).

The multiway valve 320 is movable between a first position (FIG. 5) corresponding to the cooling mode of the system 310 and a second position (FIG. 6) corresponding to the heating mode of the system 310. Movement of the multiway valve 320 between the first and second positions switches the system 310 between the cooling and heating modes. The multiway valve 320 can include a movable valve member (e.g., a slidable body or a rotatable body) that is movable between relative to a valve body between the first and second positions and can be actuated by a solenoid, stepper motor, or other electromechanical actuator. A control module controls operation of the valve 320 and controls movement between the first and second positions. The control module may also control operation of the expansion device(s) 314, the compressor 10, and the fans 328, 332 of the outdoor and indoor heat exchangers 312, 318.

The valve body of the multiway valve 320 may include a first port 340, a second port 342, a third port 344, and a fourth port 346. In the cooling mode (FIG. 5), the movable valve member of the multiway valve 320 is positioned such that the first and second ports 340, 342 are in fluid communication with each other and the third and fourth ports 344, 346 are in fluid communication with each other. In this manner, when the system 310 is in the cooling mode, the multiway valve 320 directs working fluid discharged from the compressor 10 (e.g., via discharge fitting 39) to the outdoor heat exchanger 312 (via the first and second ports 340, 342), and the multiway valve 320 directs working fluid from the indoor heat exchanger 318 toward the suction-gas-inlet fitting 40 of the compressor 10 (via the third and fourth ports 344, 346). In the heating mode (FIG. 6), the movable valve member of the multiway valve 320 is positioned such that the first and fourth ports 340, 346 are in fluid communication with each other and the second and third ports 342, 344 are in fluid communication with each other. In this manner, when the system 310 is in the heating mode, the multiway valve 320 directs working fluid discharged from the compressor 10 (e.g., via discharge fitting 39) to the indoor heat exchanger 318, and the multiway valve 320 directs working fluid from the outdoor heat exchanger 314 toward the suction-gas-inlet fitting 40 of the compressor 10.

The system 310 includes the conduit 246, which, as described above, is fluidly connected with the fourth passage 242 of the modulation control valve 158 (shown in FIGS. 2 and 3). As shown in FIGS. 5 and 6, an end 348 of the conduit 246 is fluidly coupled with a working-fluid line 350 that extends from the indoor heat exchanger 318 to the fourth port 346 of the multiway valve 320.

When the system 310 is in the cooling mode (FIG. 5), suction-pressure working fluid (or low-pressure working fluid) may flow from the indoor heat exchanger 318 through the working-fluid line 350 toward the fourth port 346 and the end 348 of the conduit 246. A portion of the suction-pressure working fluid in the working-fluid line 350 may flow to the fourth port 346 of the multiway valve 320 (and subsequently flows, via the third port 344, toward the suction-gas-inlet fitting 40 of the compressor 10), and another portion of the suction-pressure working fluid in the working-fluid line 350 may flow into the conduit 246 and into the fourth passage 242 (FIG. 3) of the modulation control valve 158.

Therefore, when the system 310 is in the cooling mode, the conduit 246 provides suction-pressure (or low-pressure) working fluid to the fourth passage 242 of the modulation control valve 158 such that both longitudinal ends of the valve member 232 of the modulation control valve 158 are exposed to suction-pressure (or low-pressure) working fluid (note that, as described above, the fifth passage 244 of the modulation control valve 158 is exposed to suction-pressure working fluid of the suction-pressure chamber 42 in both of the heating and cooling modes). Therefore, with both longitudinal ends of the valve member 232 of the modulation control valve 158 being exposed to suction-pressure (or low-pressure) working fluid in the cooling mode, the biasing member 233 of the modulation control valve 158 forces the valve member 232 into the second position (FIG. 3) to cause the axial biasing chamber 202 and modulation control chamber 198 to be in fluid communication with each other (via the first and second control passages 200, 201 of the valve ring 154 and the first and second passages 236, 238 of the modulation control valve 158). As described above, fluid communication between the axial biasing chamber 202 and modulation control chamber 198 allows the valve ring 154 to move upward to the second position (shown in FIG. 3), which opens the modulation ports 112 in the non-orbiting scroll 70 to vent the intermediate compression pockets 96, 97 to the suction-pressure chamber 42 (via the modulation ports 112 and a flow path 113 underneath the lift ring 156 (i.e., around protrusions 192), as shown in FIG. 3), thereby lowering the capacity of the compressor 10 to the reduced-capacity mode (FIG. 3).

When the system 310 is in the heating mode (FIG. 6), discharge-pressure working fluid (or high-pressure working fluid) may flow from the discharge fitting 39 of the compressor 10, through the first and fourth ports 340, 346 of the multiway valve 320, and into the working-fluid line 350. A portion of the discharge-pressure working fluid in the working-fluid line 350 may flow to indoor heat exchanger 318 (and subsequently flows through the expansion device 314, outdoor heat exchanger 312 and back to the compressor 10), and another portion of the discharge-pressure working fluid in the working-fluid line 350 may flow into the conduit 246 and into the fourth passage 242 (FIG. 2) of the modulation control valve 158.

Therefore, when the system 310 is in the heating mode, the conduit 246 provides discharge-pressure (or high-pressure) working fluid to the fourth passage 242 of the modulation control valve 158 such that a first longitudinal end (i.e., the end defining the stem 250) of the valve member 232 of the modulation control valve 158 is exposed to discharge-pressure working fluid while the second longitudinal end of the valve member 232 (i.e., the end at the fifth passage 244) of the modulation control valve 158 is exposed to suction-pressure (or low-pressure) working fluid. Therefore, the discharge-pressure working fluid at the first longitudinal end of the valve member 232 overcomes the biasing force of the biasing member 233 and pushes the valve member 232 into the first position (FIG. 2) to cause the modulation control chamber 198 to be in fluid communication with the suction-pressure chamber 42 (via the second and third passages of the modulation control valve 158). As described above, fluid communication between the modulation control chamber 198 and the suction-pressure chamber 42 allows the intermediate-pressure working fluid in the axial biasing chamber 202 to push the valve ring 154 downward to the first position (shown in FIG. 2), which closes the modulation ports 112 in the non-orbiting scroll 70 to seal off the intermediate compression pockets, thereby causing the compressor 10 to operate in the full-capacity mode (FIG. 2).

Accordingly, as described above, the compressor 10 operates in the reduced-capacity mode (FIG. 3) when the system 310 is in the cooling mode (FIG. 5), and the compressor 10 operates in the full-capacity mode (FIG. 2) when the system 310 is in the heating mode (FIG. 6). Furthermore, as described above, the capacity modulation assembly 28 is actuated solely by fluid pressure differential. That is, the modulation control valve 158 is not electronically actuated, and therefore, may be simpler and less costly to manufacture. The system 310 may include a control module (not shown) that controls operation of one or more of the compressor 10, multiway valve 320, expansion devices 314, and fans 328, 332.

Figure 7:
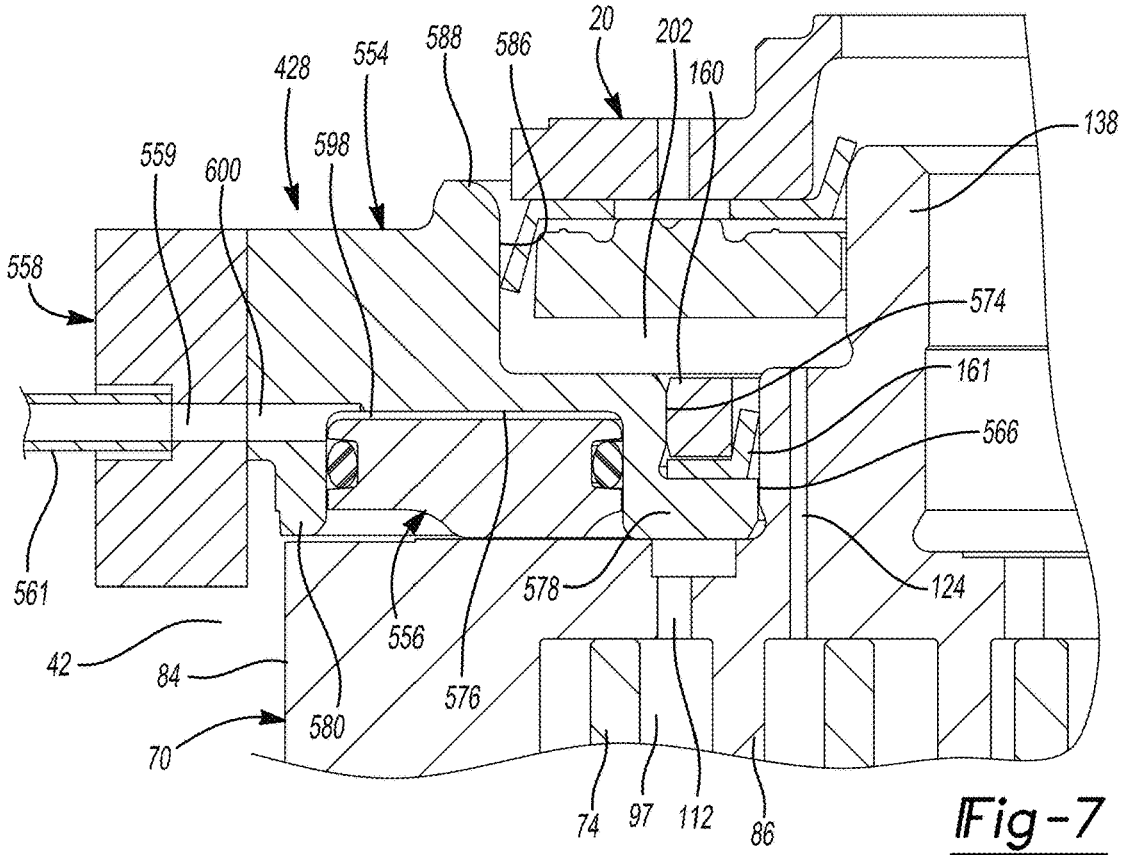
FIG. 7 is a partial cross-sectional view of a scroll of the compressor with an alternative capacity-modulation assembly in a full-capacity position.
Figure 8:
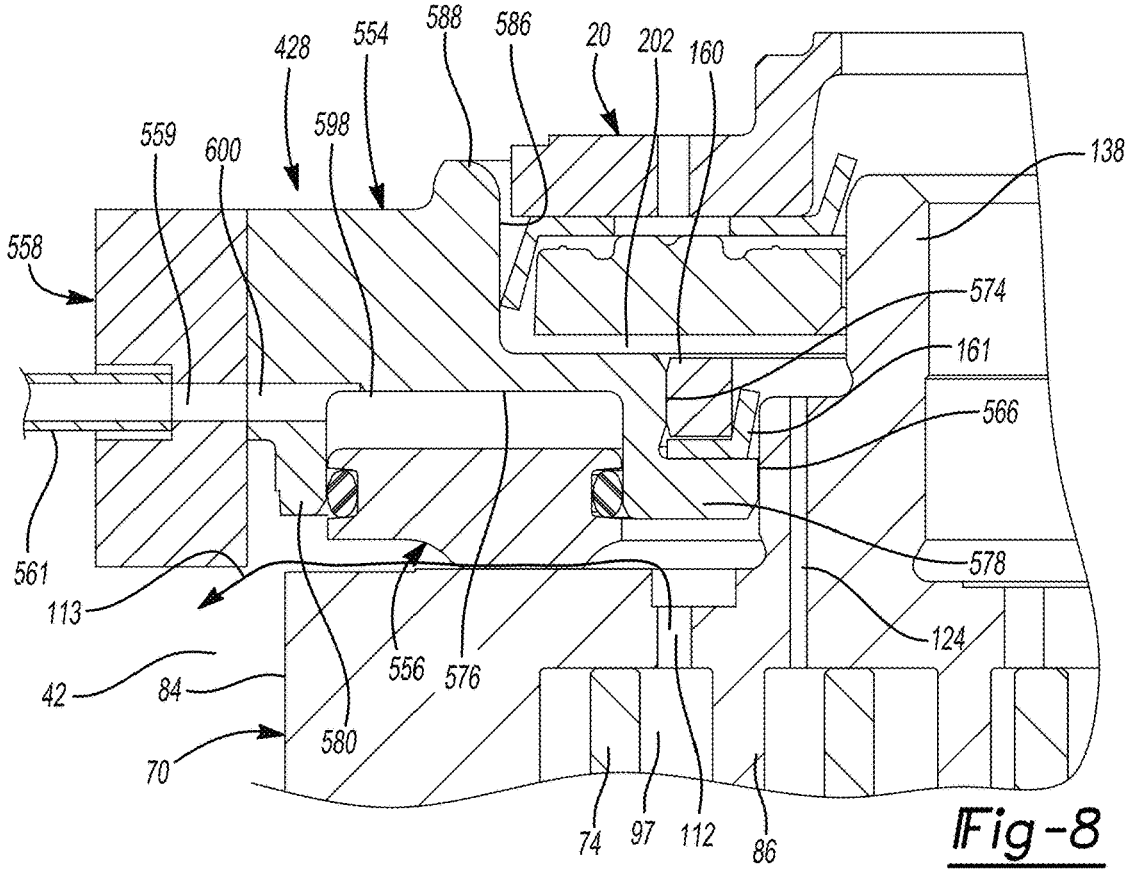
FIG. 8 is a partial cross-sectional view of the scroll and capacity-modulation assembly of FIG. 7 in a reduced-capacity position.

Referring now to FIGS. 7 and 8, another capacity modulation assembly 428 is provided that be incorporated into the compressor 10 in place of the capacity modulation assembly 28 described above. The structure and function of the capacity modulation assembly 428 may be similar or identical to that of the capacity modulation assembly 28 described above, apart from any differences described below and/or shown in the figures. Like the capacity modulation assembly 28, the capacity modulation assembly 428 is operable to switch the compressor 10 between a first capacity mode (e.g., a full-capacity or high-capacity mode; shown in FIG. 7) and a second capacity mode (e.g., a reduced-capacity or low-capacity mode; shown in FIG. 8). In the full-capacity mode, fluid communication between the modulation ports 112 and the suction-pressure chamber 42 is prevented. In the reduced-capacity mode, the modulation ports 112 are allowed to fluidly communicate with the suction-pressure chamber 42 to vent intermediate-pressure working fluid from intermediate compression pockets (e.g., pockets 96, 97) to the suction-pressure chamber 42.

The capacity modulation assembly 428 may include a valve ring 554 and a lift ring 556. The lift ring 556 may be similar or identical to the lift ring 156 described above (e.g., including an annular body 190 and a plurality of posts or protrusions 192). Unlike the capacity modulation assembly 28, some embodiments of the capacity modulation assembly 428 may not include a modulation control valve (e.g., like the modulation control valve 158). In some embodiments, the capacity modulation assembly 428 may include a modulation control fitting 558 (described in more detail below) instead of the modulation control valve 158.

The structure and function of the valve ring 554 may be similar or identical to that of the valve ring 154 described above apart from any differences described below and/or shown in the figures. Like the valve ring 154, the valve ring 554 may be an annular body having a stepped central opening 566 extending therethrough and through which the hub 138 extends. Like the valve ring 154, the central opening 566 of the valve ring 554 is defined by a plurality of steps in the valve ring 554 that form a plurality of annular recesses. A first annular recess 574 may be formed proximate a lower axial end of the valve ring 154 and may receive seal ring 160. As described above, the seal ring 160 sealingly engages the valve ring 554 and the hub 138 of the non-orbiting scroll 70. A second annular recess 576 may encircle the first annular recess 574 and may be defined by inner and outer lower annular rims 578, 580 of the valve ring 554. The lift ring 556 is partially received in the second annular recess 576. A third annular recess 586 may be disposed axially above the first and second annular recesses 574, 576 and may be defined by an axially upper rim 588 of the valve ring 554. The third annular recess 586 may receive a portion of the floating seal assembly 20. As described above, the floating seal assembly 20 cooperates with the hub 138 and the valve ring 554 to define an axial biasing chamber 202.

The valve ring 554 is movable in an axial direction (i.e., a direction along or parallel to a rotational axis of the driveshaft 62) relative to the end plate 84 between a first position (FIG. 7) and a second position (FIG. 8). In the first position (FIG. 7), the inner rim 578 of the valve ring 554 contacts the end plate 84 and closes off the modulation ports 112 to prevent fluid communication between the modulation ports 112 and the suction-pressure chamber 42. In the second position (FIG. 8), the inner rim 578 of the valve ring 554 is spaced apart from the end plate 84 to open the modulation ports 112 to allow fluid communication between the modulation ports 112 and the suction-pressure chamber 42. As described above, the lift ring 556 remains stationary relative to the end plate 84 while the valve ring 554 and seal ring 560 move axially relative to the end plate 84 between the first and second positions (see FIGS. 7 and 8).

As described above, the annular body of the lift ring 556 may cooperate with the valve ring 554 to define a modulation control chamber 598. That is, the modulation control chamber 598 is defined by and disposed axially between opposing axially facing surfaces of the lift ring 556 and the valve ring 554. The valve ring 554 includes a control passage 600 that extends from the modulation control chamber 598 to the modulation control fitting 558 (i.e., the control passage 600 fluidly communicates with the modulation control chamber 598 and the modulation control fitting 558).

The modulation control fitting 558 may be mounted to the valve ring 554 and may include a passage 559 that is fluidly connected to the control passage 600. A conduit 561 is fluidly connected to the passage 559 and may extend outward from the modulation control fitting 558. In some embodiments, the conduit 561 may be connected directly to the control passage 600.

As will be described in more detail below, the conduit 561 selectively provides high-pressure working fluid (e.g., discharge-pressure working fluid or working fluid at a pressure higher than suction pressure) to the modulation control chamber 598 (via the control passage 600) to control movement of the valve ring 554. The conduit 561 may extend from the modulation control fitting 558 (or from the valve ring 554) and through the shell assembly 12 of the compressor 10.

Figure 9:
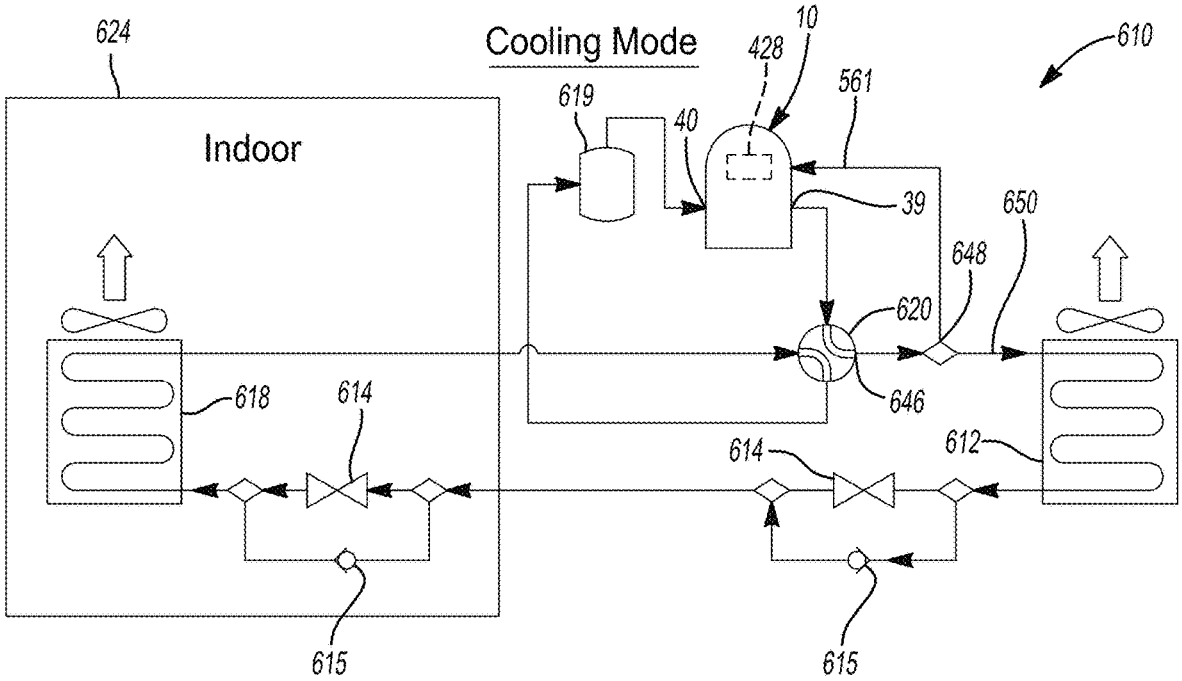
FIG. 9 is a schematic representation of a climate-control system including the compressor and capacity modulation assembly of FIGS. 7 and 8, wherein the climate-control system is operating in a cooling mode.
Figure 10:
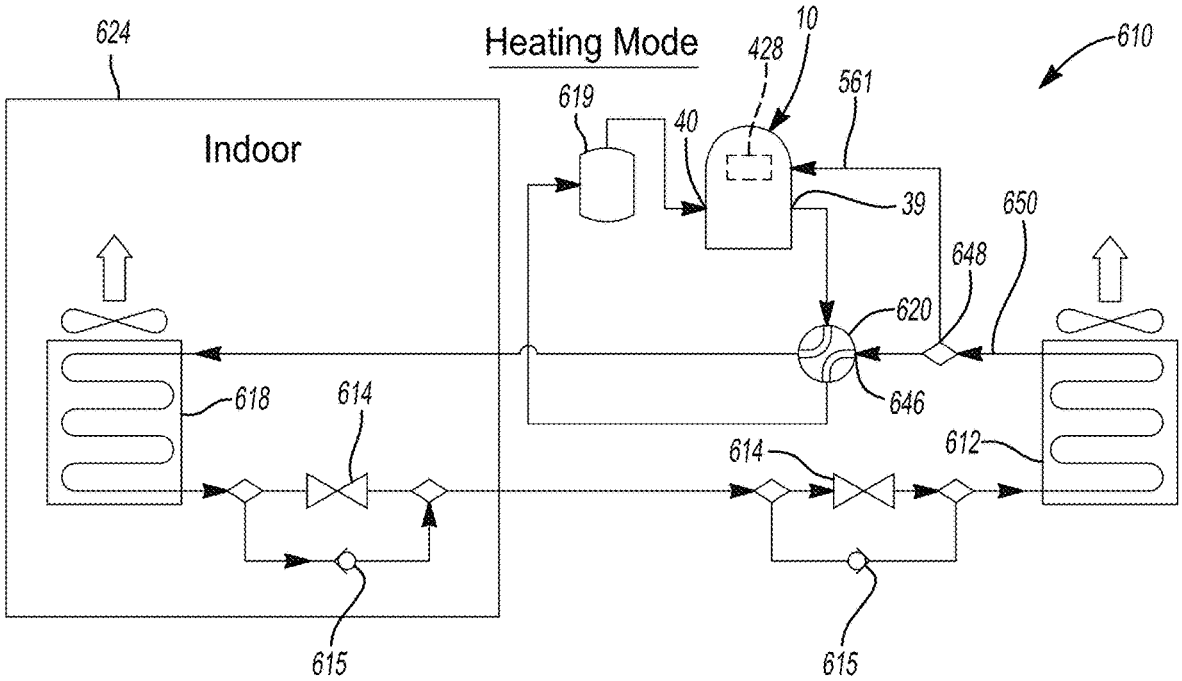
FIG. 10 is a schematic representation of the climate-control system of FIG. 9 operating in a heating mode.

Referring now to FIGS. 9 and 10, a climate-control system (e.g., a heat pump system) 610 is provided. The climate-control system 610 may include the compressor 10 (with the capacity modulation assembly 428), an outdoor heat exchanger 612 (similar or identical to outdoor heat exchanger 312), one or more expansion devices 614 (similar or identical to expansion devices 314), an indoor heat exchanger 618 (similar or identical to indoor heat exchanger 318), an accumulator 619, and a multiway valve (reversing valve) 620 (similar or identical to multiway valve 320). The indoor heat exchanger 618 may be disposed indoors (i.e., inside of a home or building 624), and the compressor 10 and outdoor heat exchanger 612 may be disposed outdoors (i.e., outside of the home or building 624). The expansion device(s) 614 and the valve 620 may be disposed outdoors or indoors.

The climate-control system 610 may be operable in a cooling mode (FIG. 9) and in a heating mode (FIG. 10). In the heating and cooling modes, the compressor 10 may pump the working fluid (e.g., a refrigerant, for example) through the climate-control system 610 in the heating and cooling modes. Working fluid may be received through the suction-gas-inlet fitting 40 of the compressor 10 and is compressed by the compression mechanism 18. Discharge-pressure working fluid is discharged from the compressor 10 through the discharge fitting 39.

In configurations of the system 610 having two expansion devices 614, one of the expansion devices 614 may be closed in the cooling mode (a check valve 615 allows working fluid to bypass the closed expansion device 614 in the cooling mode) and open in the heating mode, and the other of the expansion devices 614 may be open in the cooling mode and closed in the heating mode (another check valve 615 allows working fluid to bypass the closed expansion device 614 in the heating mode).

The multiway valve 620 is movable between a first position (FIG. 9) corresponding to the cooling mode of the system 610 and a second position (FIG. 10) corresponding to the heating mode of the system 610. Movement of the multiway valve 620 between the first and second positions switches the system 610 between the cooling and heating modes. A control module controls operation of the valve 620 and controls movement between the first and second positions. The control module may also control operation of the expansion device(s) 614, the compressor 10, and the fans of the outdoor and indoor heat exchangers 612, 618.

When the system 610 is in the cooling mode, the multiway valve 620 directs working fluid discharged from the compressor 10 (e.g., via discharge fitting 39) to the outdoor heat exchanger 612 and the conduit 561, and the multiway valve 620 directs working fluid from the indoor heat exchanger 618 toward the suction-gas-inlet fitting 40 of the compressor 10. In the heating mode (FIG. 10), the multiway valve 620 directs working fluid discharged from the compressor 10 (e.g., via discharge fitting 39) to the indoor heat exchanger 618, and the multiway valve 620 directs working fluid from the outdoor heat exchanger 614 toward the suction-gas-inlet fitting 40 of the compressor 10.

As shown in FIGS. 9 and 10, an end 648 of the conduit 561 is fluidly coupled with a working-fluid line 650 that extends between the outdoor heat exchanger 612 and a port 646 of the multiway valve 620.

When the system 610 is in the cooling mode (FIG. 9), discharge-pressure working fluid (or high-pressure working fluid) may flow from the discharge fitting 39 of the compressor 10 and into the working-fluid line 650 (e.g., via port 646 of the multiway valve 620). A portion of the discharge-pressure working fluid in the working-fluid line 650 may flow to the outdoor heat exchanger 612, and another portion of the discharge-pressure working fluid in the working-fluid line 650 may flow into the conduit 561, through the control passage 600 of the valve ring 554 (e.g., via passage 559 of modulation control fitting 558) and into the modulation control chamber 598 (see FIG. 8). Allowing discharge-pressure working fluid into the modulation control chamber 598 allows the valve ring 554 to move upward to the second position (shown in FIG. 8), which opens the modulation ports 112 in the non-orbiting scroll 70 to vent the intermediate compression pockets 96, 97 to the suction-pressure chamber 42 (via the modulation ports 112 and flow path 113 underneath the lift ring 556 (i.e., around protrusions 192 of the lift ring 556), as shown in FIG. 8), thereby lowering the capacity of the compressor 10 to the reduced-capacity mode (FIG. 8).

When the system 610 is in the heating mode (FIG. 10), suction-pressure working fluid (or low-pressure working fluid) may flow from the outdoor heat exchanger 612 into the working-fluid line 650. A portion of the suction-pressure working fluid in the working-fluid line 650 may flow to port 646 of the multiway valve 620 (and subsequently flows back to the compressor 10 (e.g., via accumulator 619 and suction fitting 40)), and another portion of the suction-pressure working fluid in the working-fluid line 650 may flow into the conduit 561 (which is in fluid communication with the modulation control chamber 598). With the conduit 561 at suction pressure (or low pressure), working fluid in the modulation control chamber 598 is also at suction pressure (or low pressure), which allows the intermediate-pressure working fluid in the axial biasing chamber 202 to push the valve ring 554 downward to the first position (shown in FIG. 7), which closes the modulation ports 112 in the non-orbiting scroll 70 to seal off the intermediate compression pockets, thereby causing the compressor 10 to operate in the full-capacity mode (FIG. 7).

Accordingly, as described above, the compressor 10 operates in the reduced-capacity mode (FIG. 8) when the system 610 is in the cooling mode (FIG. 9), and the compressor 10 operates in the full-capacity mode (FIG. 7) when the system 610 is in the heating mode (FIG. 10). Furthermore, as described above, the capacity modulation assembly 428 is actuated solely by fluid pressure differential and does not require a modulation control valve. The system 610 may include a control module (not shown) that controls operation of one or more of the compressor 10, multiway valve 620, expansion devices 614, and heat exchanger fans.

Figure 11:
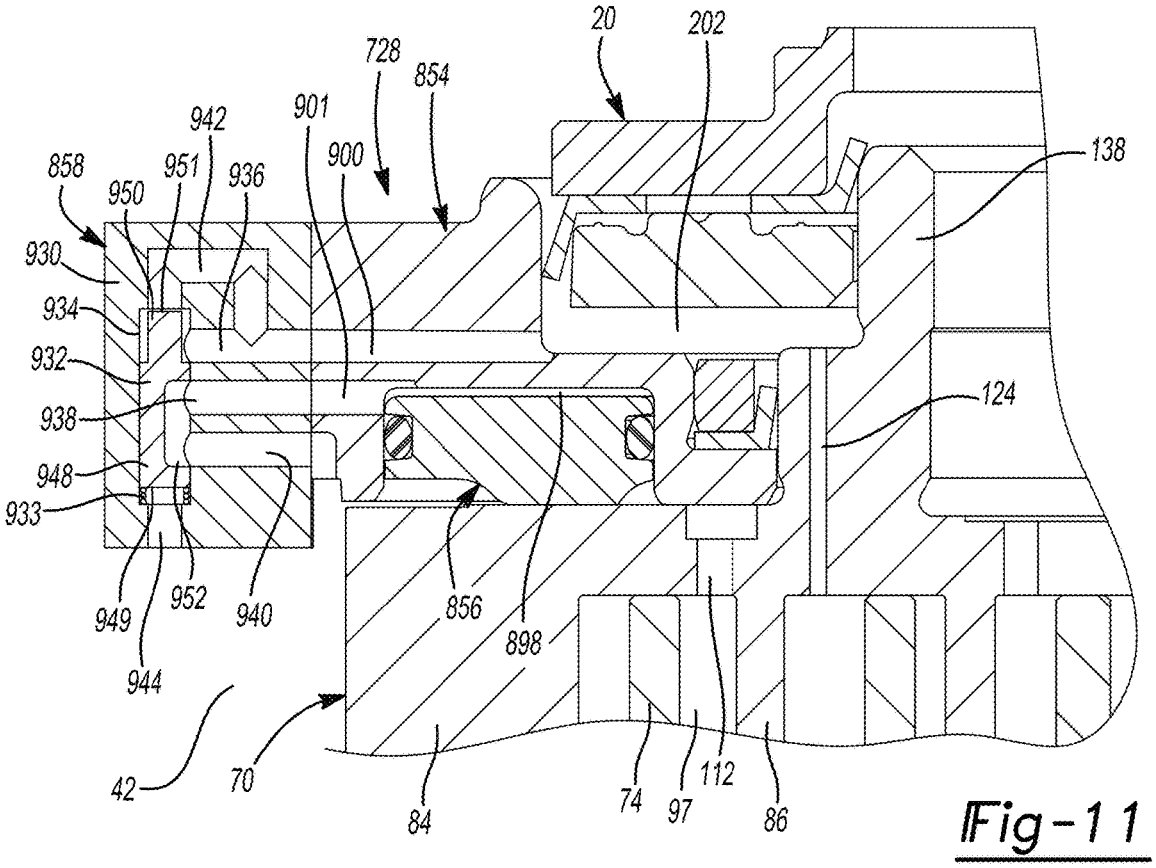
FIG. 11 is a partial cross-sectional view of a scroll of the compressor with another alternative capacity-modulation assembly in a full-capacity position.
Figure 12:
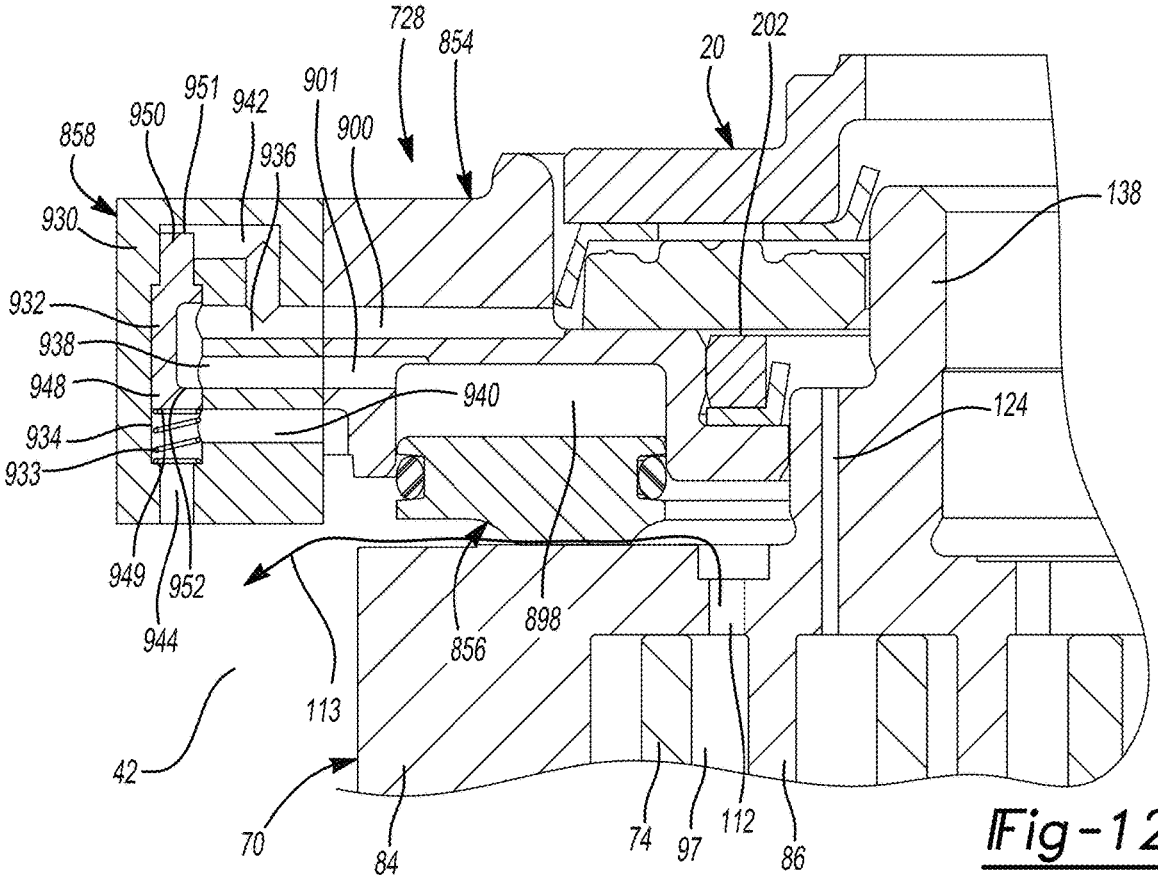
FIG. 12 is a partial cross-sectional view of the scroll and capacity-modulation assembly of FIG. 11 in a reduced-capacity position.

Referring now to FIGS. 11 and 12, another capacity modulation assembly 728 is provided that be incorporated into the compressor 10 in place of the capacity modulation assembly 28 described above. The structure and function of the capacity modulation assembly 728 may be similar or identical to that of the capacity modulation assembly 28 described above, apart from any differences described below and/or shown in the figures. Like the capacity modulation assembly 28, the capacity modulation assembly 728 is operable to switch the compressor 10 between a first capacity mode (e.g., a full-capacity or high-capacity mode; shown in FIG. 11) and a second capacity mode (e.g., a reduced-capacity or low-capacity mode; shown in FIG. 12). In the full-capacity mode, fluid communication between the modulation ports 112 and the suction-pressure chamber 42 is prevented. In the reduced-capacity mode, the modulation ports 112 are allowed to fluidly communicate with the suction-pressure chamber 42 to vent intermediate-pressure working fluid from intermediate compression pockets (e.g., pockets 96, 97) to the suction-pressure chamber 42.

The capacity modulation assembly 728 may include a valve ring 854, a lift ring 856, and a modulation control valve 858. The valve ring 854 and lift ring 856 may be similar or identical to the valve ring 154 and lift ring 156, respectively, described above. As described above, the floating seal assembly 20 cooperates with the hub 138 and the valve ring 854 to define an axial biasing chamber 202. As described above, the annular body of the lift ring 856 may cooperate with the valve ring 854 to define a modulation control chamber 898 (similar or identical to modulation control chamber 198). That is, the modulation control chamber 898 is defined by and disposed axially between opposing axially facing surfaces of the lift ring 856 and the valve ring 854. The valve ring 854 includes a first control passage 900 and a second control passage 901. The first control passage 900 may extend from the axial biasing chamber 202 to the modulation control valve 858 (i.e., the first control passage 900 fluidly communicates with the axial biasing chamber 202 and the modulation control valve 858). The second control passage 901 extends from the modulation control chamber 898 to the modulation control valve 858 (i.e., the second control passage 901 fluidly communicates with the modulation control chamber 898 and the modulation control valve 858).

As shown in FIGS. 11 and 12, the modulation control valve 858 may include a valve body 930 and a valve member 932. The valve member 932 is movable relative to the valve body 930 between a first position (FIG. 11) and a second position (FIG. 12). Movement of the valve member 932 into the first position switches the compressor 10 into the full-capacity mode (FIG. 11) and prevents fluid communication between the modulation ports 112 and the suction-pressure chamber 42. Movement of the valve member 932 into the second position switches the compressor 10 into the reduced-capacity mode (FIG. 12) and allows fluid communication between the modulation ports 112 and the suction-pressure chamber 42.

As shown in FIGS. 11 and 12, the valve body 930 may include an internal cavity 934, a first passage 936, a second passage 938, a third passage 940, a fourth passage 942, and a fifth passage 944. The first, second, third, fourth, and fifth passages 936, 938, 940, 942, 944 are in fluid communication with the internal cavity 934 of the valve body 930. The valve body 930 may be mounted to the valve ring 854 such that the first and second passages 936, 938 of the valve body 930 are aligned with and in fluid communication with the first and second control passages 900, 901, respectively. That is, the first passage 936 may be aligned with and in fluid communication with the first control passage 900, and the second passage 938 may be aligned with and in fluid communication with the second control passage 901. The third and fifth passages 940, 944 of the valve body 930 may be in fluid communication with the suction-pressure chamber 42. The fourth passage 942 of the valve body 930 may be fluidly connected with the first passage 936.

The valve member 932 may include a main body 948 and a stem 950. The stem 950 has a smaller width or diameter than the main body 948. The valve member 932 is disposed within the internal cavity 934 and is movable therein between the first position (FIG. 11) and the second position (FIG. 12). The stem 950 of the valve member 932 may be reciprocatingly received in the fourth passage 942 of the valve body 930. A cutout 952 may be formed in the main body 948 of the valve member 932. The cutout 952 is open to (in fluid communication with) the internal cavity 934. When the valve member 932 is in the first position (FIG. 11), the cutout 952 is in fluid communication with the second and third passages 938, 940 of the valve body 930 to allow fluid communication between the modulation control chamber 898 and the suction-pressure chamber 42 (via the second control passage 901 in the valve ring 854) while preventing fluid communication between the first control passage 900 and the second control passage 901). When the valve member 932 is in the second position (FIG. 12), the cutout 952 is in fluid communication with the first and second passages 936, 938 of the valve body 930 to allow fluid communication between the modulation control chamber 898 and the axial biasing chamber 202 (via the first and second control passages 900, 901 in the valve ring 854) while preventing fluid communication between the second control passage 901 and the suction-pressure chamber 42). As shown in FIGS. 11 and 12, the first control passage 900 is prevented from fluidly communicating with the suction-pressure chamber 42 in both of the cooling and heating modes.

The valve member 932 is movable relative to the valve body 930 between the first position (FIG. 11) and the second position (FIG. 12) in response to relative changes in fluid pressures between the axial biasing chamber 202 and the suction chamber 42. That is, a force exerted on an axial end 951 of the stem 950 of the valve member 932 by fluid pressure of fluid in the axial biasing chamber (via first control passage 900 and fourth passage 942) tends to urge the valve member 932 toward the first position (FIG. 11). A force exerted on an axial end 949 of the main body 948 of the valve member 932 (i.e., the axial end of the main body 948 opposite the end on which the stem 950 is disposed) by fluid pressure of fluid in the suction chamber 42 tends to urge the valve member 932 toward the second position (FIG. 12). When the force exerted on the axial end 951 is greater than the force exerted on the axial end 949, the valve member 932 moves toward (or remains in) the first position (FIG. 11) to switch the compressor 10 to (or keep the compressor 10 in) the full-capacity mode. When the force exerted on the axial end 949 is greater than the force exerted on the axial end 951, the valve member 932 moves toward (or remains in) the second position (FIG. 12) to switch the compressor 10 to (or keep the compressor 10 in) the reduced-capacity mode.

It should be noted that under certain compressor operating conditions, fluid in the axial biasing chamber 202 can be at a higher pressure than fluid in the suction chamber 42 and still exert a smaller force on the axial end 951 of the stem 950 than fluid in the suction chamber 42 exerts on the axial end 949 of the main body 948. This is because the stem 950 has a smaller diameter (or width) than the main body 948. Therefore, under certain operating conditions, the force on the axial end 951 (which is equal to fluid pressure in the axial biasing chamber 202 multiplied by area of the axial end 951) is less than the force on the axial end 949 (which is equal to the fluid pressure in the suction chamber 42 multiplied by the area of the axial end 949). Under such operating conditions, the valve member 932 will move toward (or remain in) in the second position (FIG. 12) to switch the compressor 10 to (or keep the compressor 10 in) the reduced-capacity mode. Under other operating conditions in which the pressure in the axial biasing chamber 202 is sufficiently higher than the pressure in the suction chamber 42, the force exerted on the axial end 951 will be higher than the force exerted on the axial end 949, which will move the valve member 932 to (or keep the valve member 932 in) the first position (FIG. 11) to switch the compressor 10 to (or keep the compressor 10 in) the full-capacity mode.

Figure 13:
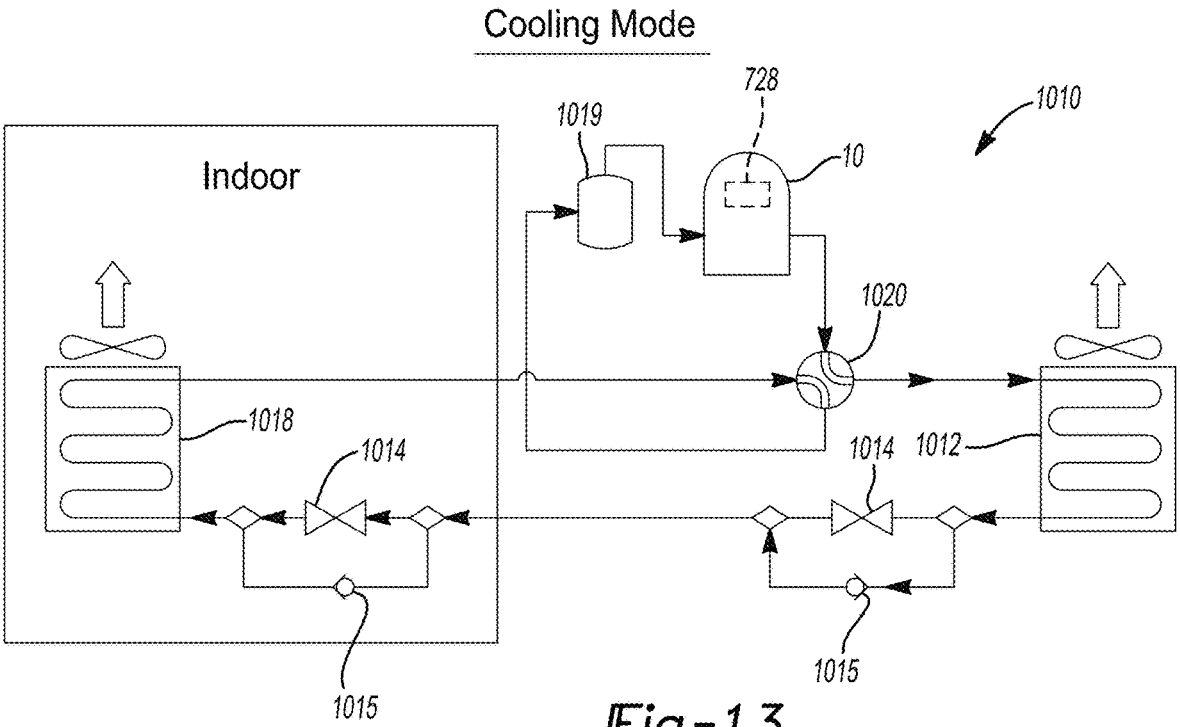
FIG. 13 is a schematic representation of a climate-control system including the compressor and capacity modulation assembly of FIGS. 11 and 12, wherein the climate-control system is operating in a cooling mode.
Figure 14:
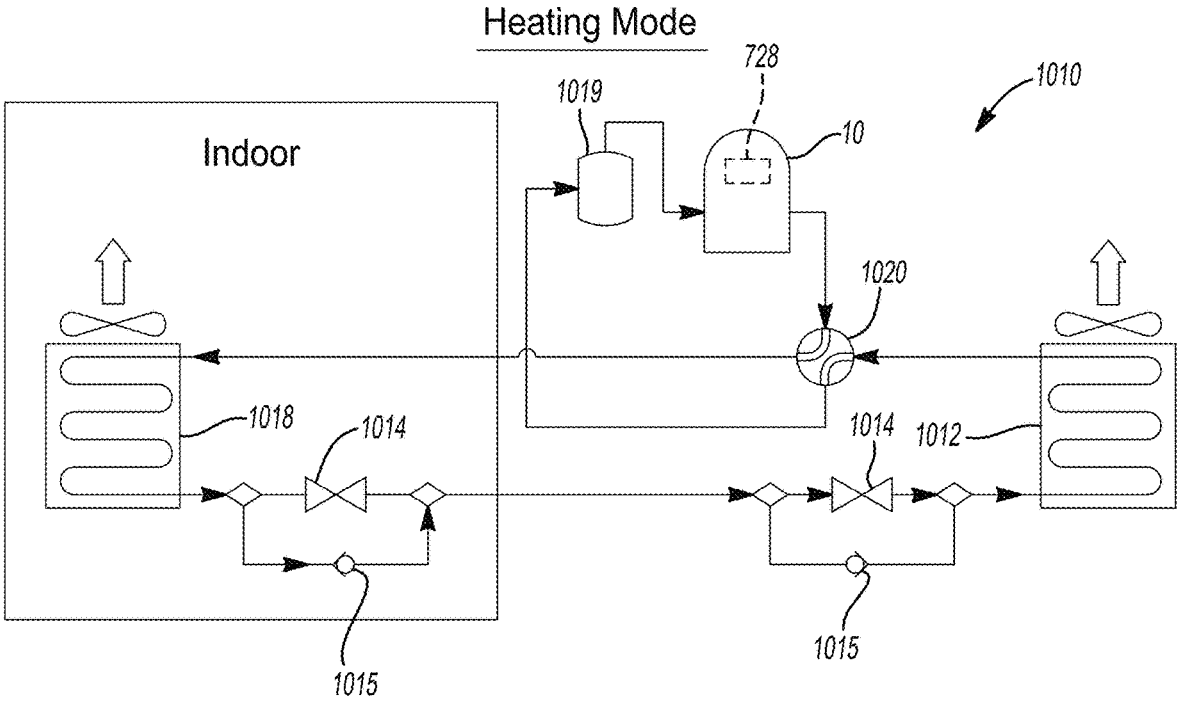
FIG. 14 is a schematic representation of the climate-control system of FIG. 13 operating in a heating mode.
Figure 15:
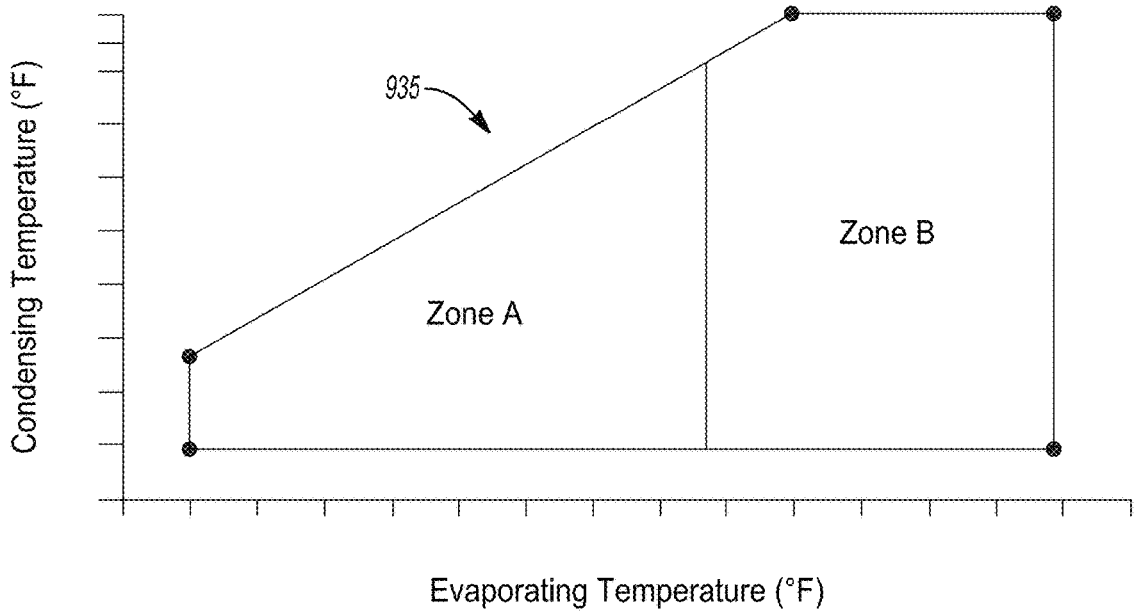
FIG. 15 is an operating map of the system of FIGS. 12 and 13.

FIG. 15 depicts an operating map 935 for the climate-control system 1010 with the compressor 10 having the capacity modulation system 728 (FIGS. 13 and 14). The operating map 935 includes a Zone A and a Zone B. In Zone A, operating conditions may be such that the differential between the fluid pressures in the axial biasing chamber 202 and the suction chamber 42 is sufficiently small such that the force exerted on the axial end 951 is less than the force exerted on the axial end 949, which causes the valve member 932 to move toward (or remain in) the second position (FIG. 12) corresponding to the reduced-capacity mode. In some configurations, the modulation control valve 858 may include a spring 933 (e.g., similar or identical to spring 233) that urges the valve member 932 toward the second position. In Zone B, operating conditions may be such that the differential between the fluid pressures in the axial biasing chamber 202 and the suction chamber 42 is sufficiently high such that the force exerted on the axial end 951 is greater than the sum of the force exerted on the axial end 949 and the force exerted by spring 933, which causes the valve member 932 to move toward (or remain in) the first position (FIG. 11) corresponding to the full-capacity mode.

FIGS. 13 and 14 depict the climate-control system 1010 having the compressor 10 with the capacity modulation system 728. FIG. 13 depicts the system 1010 operating in the cooling mode, and FIG. 14 depicts the system 1010 operating in the heating mode. The structure and function of the system 1010 may be similar or identical to that of the system 310, 610, except that the system 1010 need not include the conduit 246, 561 since the modulation control valve 858 of the capacity modulation system 728 is not connected to a conduit like the conduit 246, 561.

Like the systems 310, 610, the system 1010 may include the compressor 10, an outdoor heat exchanger 1012 (similar or identical to outdoor heat exchanger 312), one or more expansion devices 1014 (similar or identical to expansion devices 314), one or more check valves 1015 (similar or identical to check valves 315), an indoor heat exchanger 1018 (similar or identical to indoor heat exchanger 318), an accumulator 1019, and a multiway valve (reversing valve) 1020 (similar or identical to multiway valve 320). The indoor heat exchanger 1018 may be disposed indoors (i.e., inside of a home or building 1024), and the compressor 10 and outdoor heat exchanger 1012 may be disposed outdoors (i.e., outside of the home or building 1024). The expansion device(s) 1014 and the valve 1020 may be disposed outdoors or indoors. The system 1010 may include a control module (not shown) that controls operation of one or more of the compressor 10, multiway valve 1020, expansion devices 1014, and heat exchanger fans.

In some configurations, the compressor 10 having the capacity modulation system 728 (of FIGS. 11 and 12) could be incorporated into the system 610 shown in FIGS. 9 and 11 (instead of the compressor 10 having capacity modulation system 428). In such configurations, the line 561 may be connected to the fifth passage 944 of the modulation control valve 858 to provide suction-pressure fluid to the fifth passage 944 in the cooling mode (to allow the valve member 932 to move to the first position (FIG. 11) in the cooling mode) and discharge-pressure fluid to the fifth passage 944 in the heating mode (to force the valve member 932 to move to the second position (FIG. 12) in the heating mode).

Figure 16:
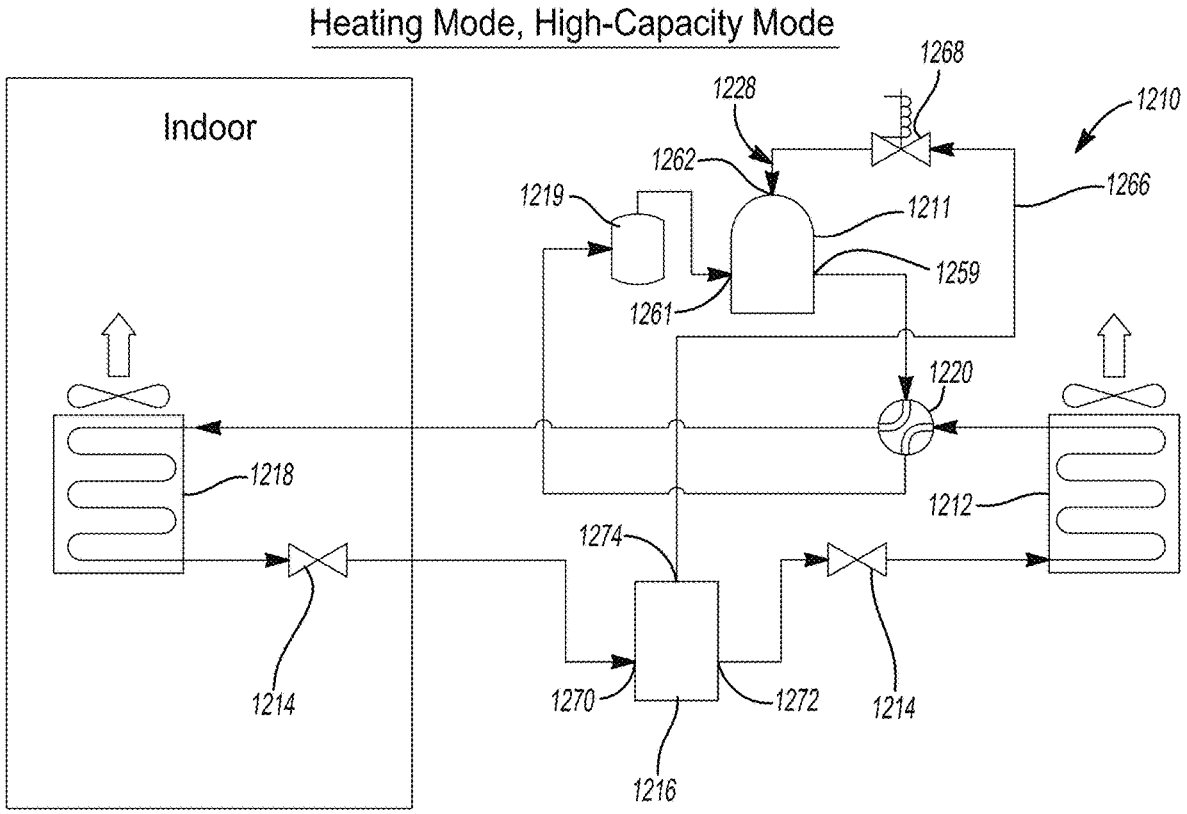
FIG. 16 is a schematic representation of another climate-control system operating in a heating mode and a high-capacity mode.
Figure 17:
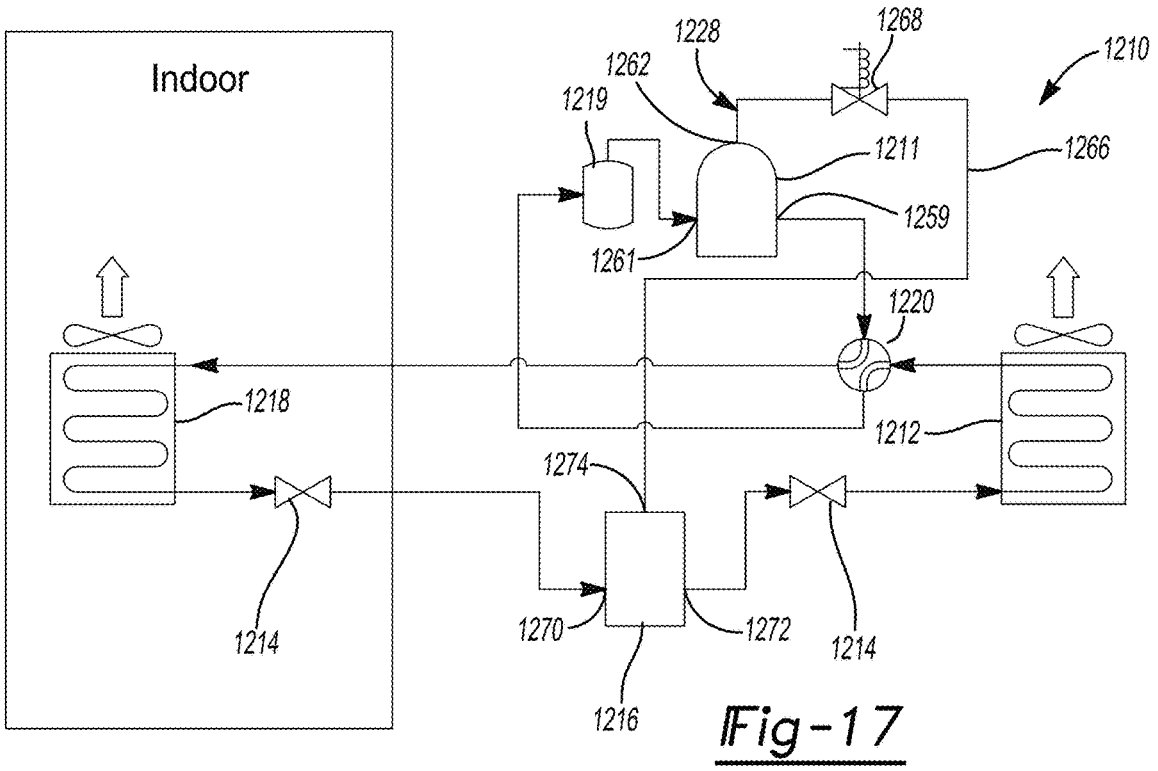
FIG. 17 is a schematic representation of the system of FIG. 16 operating in the heating mode and an intermediate-capacity mode.
Figure 18:
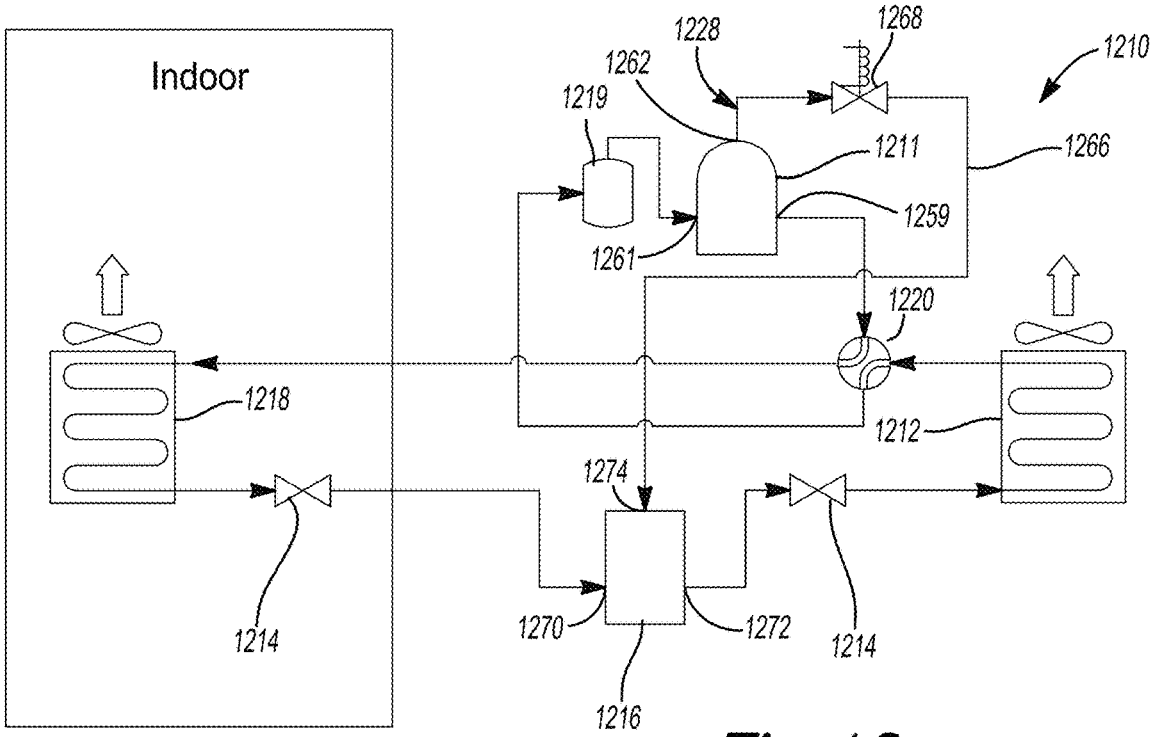
FIG. 18 is a schematic representation of the system of FIG. 16 operating in the heating mode and a low-capacity mode.
Figure 19:
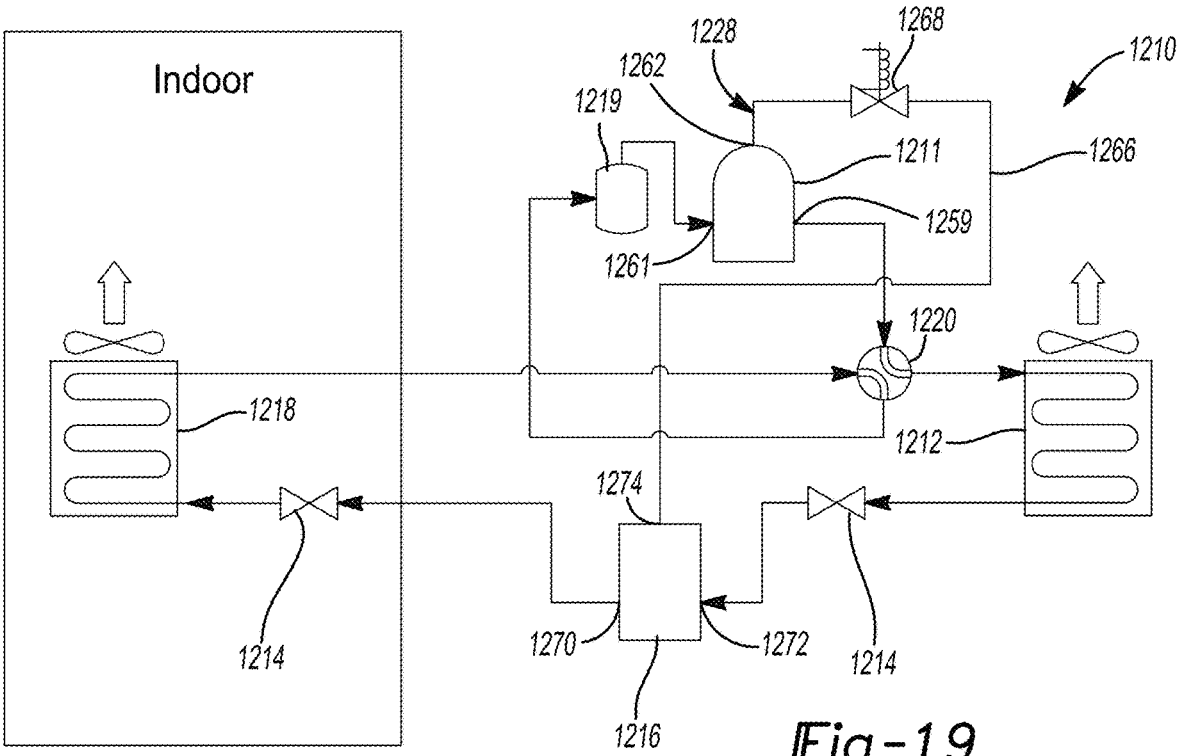
FIG. 19 is a schematic representation of the system of FIG. 16 operating in a cooling mode and the intermediate-capacity mode.
Figure 20:
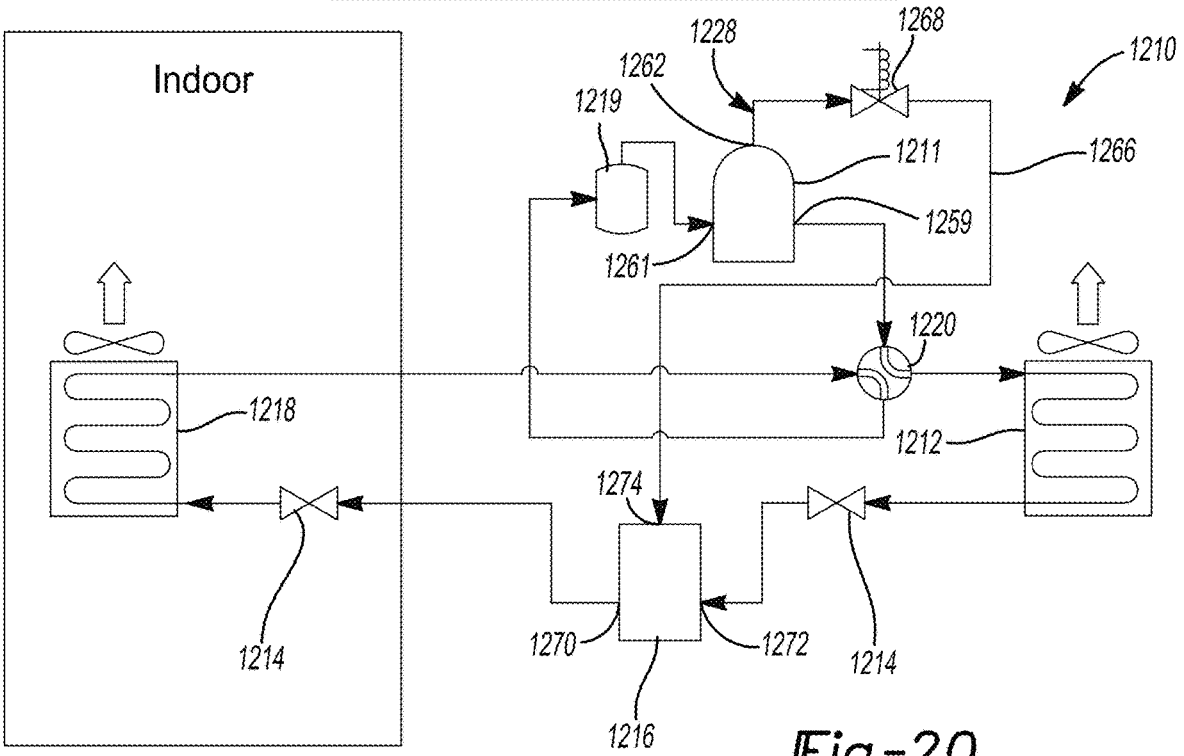
FIG. 20 is a schematic representation of the system of FIG. 16 operating in the cooling mode and the low-capacity mode.

Referring now to FIGS. 16-20, another climate-control system 1210 is provided. As will be described in more detail below, the system 1210 may be operable in a heating mode and in a cooling mode and at first, second, and third capacity modes or stages. FIG. 16 shows the system 1210 operating in the heating mode and in a high-capacity mode. FIG. 17 shows the system 1210 operating in the heating mode and in an intermediate-capacity mode. FIG. 18 shows the system 1210 operating in the heating mode and in a low-capacity mode. FIG. 19 shows the system 1210 operating in the cooling mode and in the intermediate-capacity mode. FIG. 20 shows the system 1210 operating in the cooling mode and in the low-capacity mode. While not specifically shown in the figures, in some configurations, the system 1210 may be operable in the cooling mode and in the high-capacity mode.

The system 1210 may include a compressor 1211, an outdoor heat exchanger 1212 (similar or identical to outdoor heat exchanger 312), one or more expansion devices 1214 (similar or identical to expansion devices 314), a flash tank 1216, an indoor heat exchanger 1218 (similar or identical to indoor heat exchanger 318), an accumulator 1219, and a multiway valve (reversing valve) 1220 (similar or identical to multiway valve 320).

Figure 21:
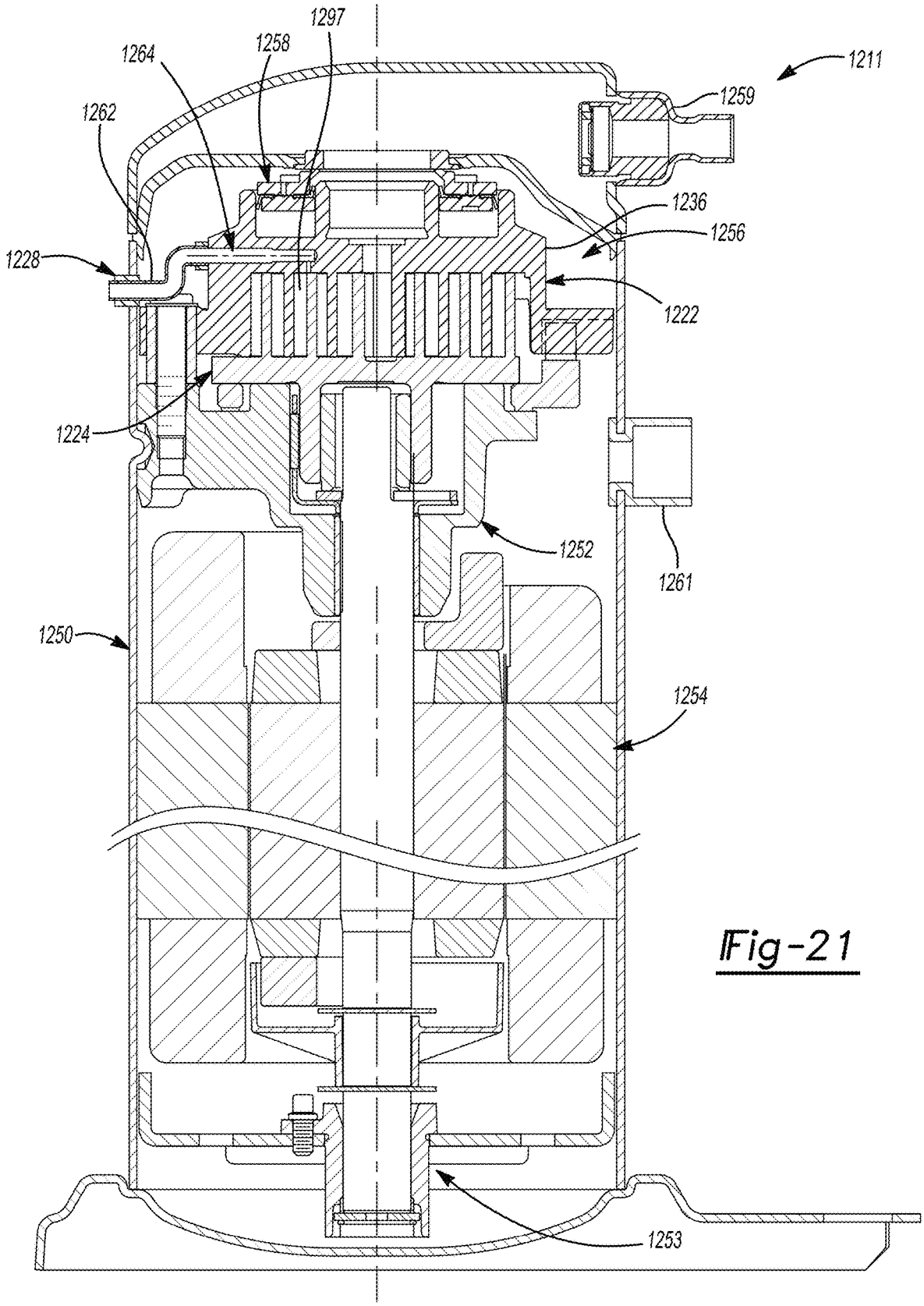
FIG. 21 is a cross-sectional view of a compressor of the system of FIGS. 16-20.

The compressor 1211 may be similar to the compressor 10 described above, except the compressor 1211 may not include the capacity modulation assembly 28, 428, 728, and instead, may include a capacity-modulation passage 1228 (which will be described in more detail below). As shown in FIG. 21, the compressor 1211 may include a shell assembly 1250 (similar or identical to the shell assembly 12), first and second bearing housing assemblies 1252, 1253 (similar or identical to the bearing housing assemblies 14, 15), a motor assembly 1254 (similar or identical to the motor assembly 16), a compression mechanism 1256 (including a non-orbiting scroll 1222 and an orbiting scroll 1224), a floating seal assembly 1258 (similar or identical to the floating seal assembly 20), a discharge fitting 1259 (similar or identical to the discharge fitting 39), a suction-gas-inlet fitting 1261 (similar or identical to the suction-gas-inlet fitting 40), and the capacity-modulation passage 1228.

The capacity-modulation passage 1228 may include a passage 1264 (formed in an end plate 1236 of the non-orbiting scroll 1222), a conduit 1262 (connected to the end plate 1236 and in fluid communication with the passage 1264), and a fluid line 1266 (FIGS. 16-20) that is coupled with the conduit 1262 and the flash tank 1216. The fluid line 1266 may include a control valve 1268 (e.g., a solenoid valve or other electromechanical valve) (FIGS. 16-20). The passage 1264 is in fluid communication with an intermediate pocket 1297 (e.g., similar or identical to intermediate pocket 97) defined by the scrolls 1222, 1224. The flash tank 1216 may include a first opening 1270, a second opening 1272, and a third opening 1274. The control valve 1268 may control a flow of vapor working fluid between the third opening 1274 of the flash tank 1216 and the intermediate pocket 1297 of the compressor 1211 (via the capacity-modulation passage 1228).

As noted above, FIG. 16 shows the system 1210 operating in the heating mode and in the high-capacity mode. In the heating mode, compressed working fluid from the discharge fitting 1259 of the compressor 1211 flows through the multiway valve 1220 and flows to the indoor heat exchanger 1218. From the indoor heat exchanger 1218, the working fluid flows through a first one of the expansion devices 1214 and then into the flash tank 1216 (via the first opening 1270). In the flash tank 1216, vapor working fluid may separate from liquid working fluid. The liquid working fluid may exit the flash tank 1216 through the second opening 1272, and then may flow through the second one of the expansion devices 1214, through the outdoor heat exchanger 1212 and back to the suction inlet 1261 of the compressor 1211.

When the system 1210 is in the high-capacity mode, the control valve 1268 may open to allow fluid flow between the intermediate pocket 1297 and the third opening 1274 of the flash tank 1216. In the high-capacity mode, the expansion devices 1214 can be controlled to cause pressure of vapor working fluid in the flash tank 1216 to be higher than the pressure of working fluid in the intermediate pocket 1297, thereby causing vapor working fluid in the flash tank 1216 to exit the flash tank 1216 through the third opening 1274 and flow into the line 1266 toward the compressor 1211. That is, the vapor working fluid may flow through the line 1266, through the control valve 1268, through the conduit 1262 and into the intermediate pocket 1297 (via passage 1264), thereby raising the capacity of the compressor 1211.

As noted above, FIG. 17 shows the system 1210 operating in the heating mode and in the intermediate-capacity mode. In the intermediate-capacity mode, the control valve 1268 may close to restrict or prevent fluid flow between the third opening 1274 of the flash tank 1216 and the intermediate pocket 1297.

As noted above, FIG. 18 shows the system 1210 operating in the heating mode and in the low-capacity mode. In the low-capacity mode, the control valve 1268 may open to allow fluid flow between the intermediate pocket 1297 and the third opening 1274 of the flash tank 1216. In the low-capacity mode, the expansion devices 1214 can be controlled to cause pressure of vapor working fluid in the flash tank 1216 to be lower than the pressure of working fluid in the intermediate pocket 1297, thereby causing working fluid in the intermediate pocket 1297 to flow out of the compressor 1211 (via passage 1264 and conduit 1262) and flow into the line 1266 toward the flash tank 1216. That is, the vapor working fluid may flow through the line 1266, through the control valve 1268, and into the third opening 1274 of the flash tank 1216. This flow of working fluid out of the intermediate pocket 1297 lowers the capacity of the compressor 1211.

As noted above, FIG. 19 shows the system 1210 operating in the cooling mode and in the intermediate-capacity mode.

In the cooling mode, compressed working fluid from the discharge fitting 1259 of the compressor 1211 flows through the multiway valve 1220 and flows to the outdoor heat exchanger 1212. From the outdoor heat exchanger 1212, the working fluid flows through a first one of the expansion devices 1214 and then into the flash tank 1216 (via the second opening 1272). In the flash tank 1216, vapor working fluid may separate from liquid working fluid. The liquid working fluid may exit the flash tank 1216 through the first opening 1270, and then may flow through the second one of the expansion devices 1214, through the indoor heat exchanger 1218 and back to the suction inlet 1261 of the compressor 1211. As noted above, when the system 1210 is operating in the intermediate-capacity mode, the control valve 1268 may close to restrict or prevent fluid flow between the third opening 1274 of the flash tank 1216 and the intermediate pocket 1297.

As noted above, FIG. 20 shows the system 1210 operating in the cooling mode and in the low-capacity mode. As described above, in the low-capacity mode, the control valve 1268 may open to allow fluid flow between the intermediate pocket 1297 and the third opening 1274 of the flash tank 1216. In the low-capacity mode, the expansion devices 1214 can be controlled to cause pressure of vapor working fluid in the flash tank 1216 to be lower than the pressure of working fluid in the intermediate pocket 1297, thereby causing working fluid in the intermediate pocket 1297 to flow out of the compressor 1211 (via passage 1264 and conduit 1262) and flow into the line 1266 toward the flash tank 1216. That is, the vapor working fluid may flow through the line 1266, through the control valve 1268, and into the third opening 1274 of the flash tank 1216. This flow of working fluid out of the intermediate pocket 1297 lowers the capacity of the compressor 1211.

The system 1210 may include a control module (not shown) that controls operation of one or more of the compressor 1211, the multiway valve 1220, the expansion devices 1214, the control valve 1268, and the heat exchanger fans.

Figure 22:
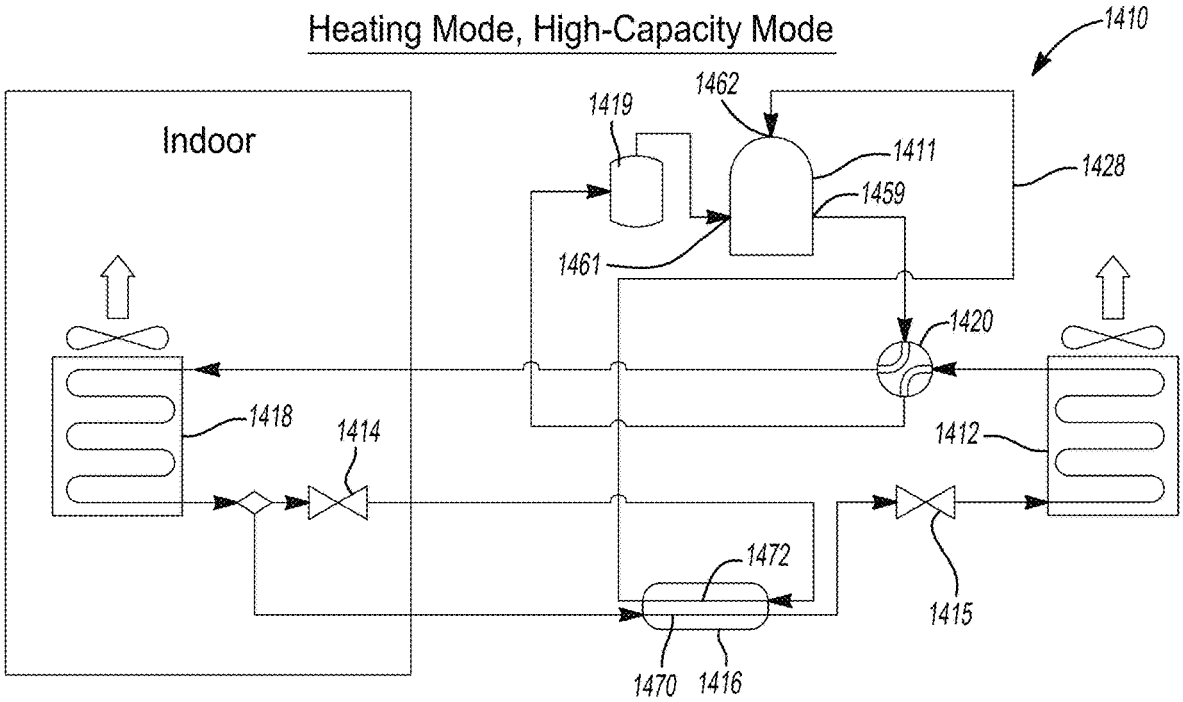
FIG. 22 is a schematic representation of yet another climate-control system operating in a heating mode and a high-capacity mode.
Figure 23:
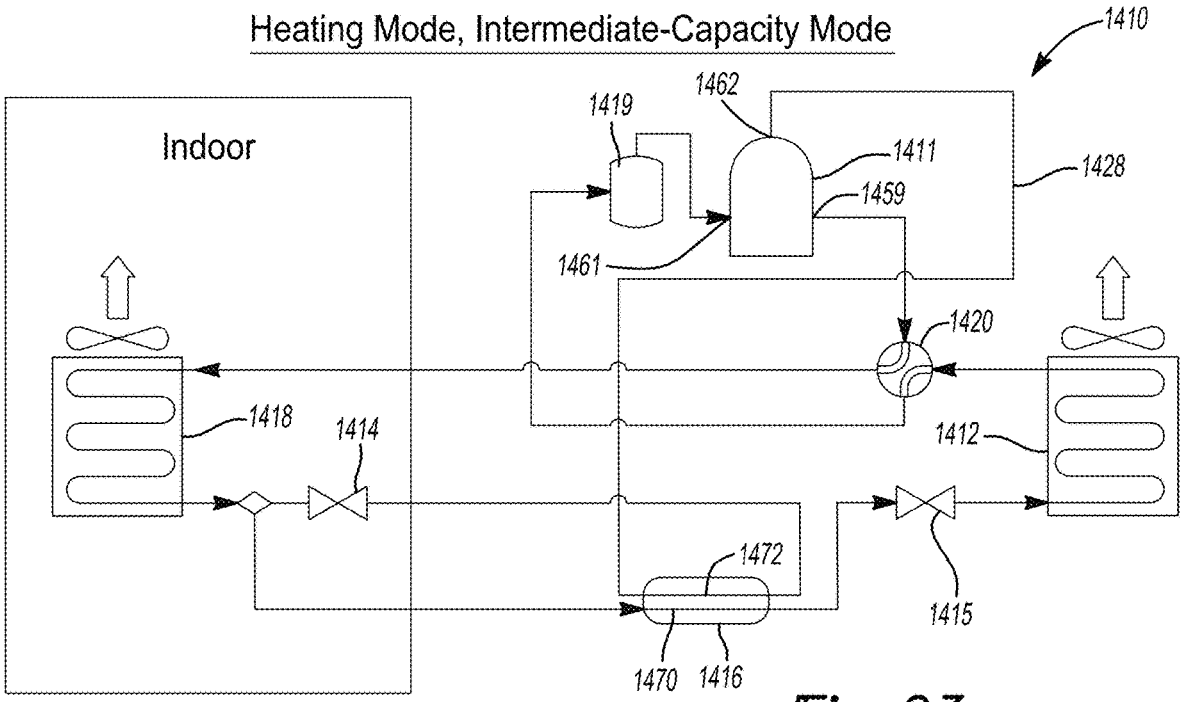
FIG. 23 is a schematic representation of the system of FIG. 22 operating in the heating mode and an intermediate-capacity mode.
Figure 24:
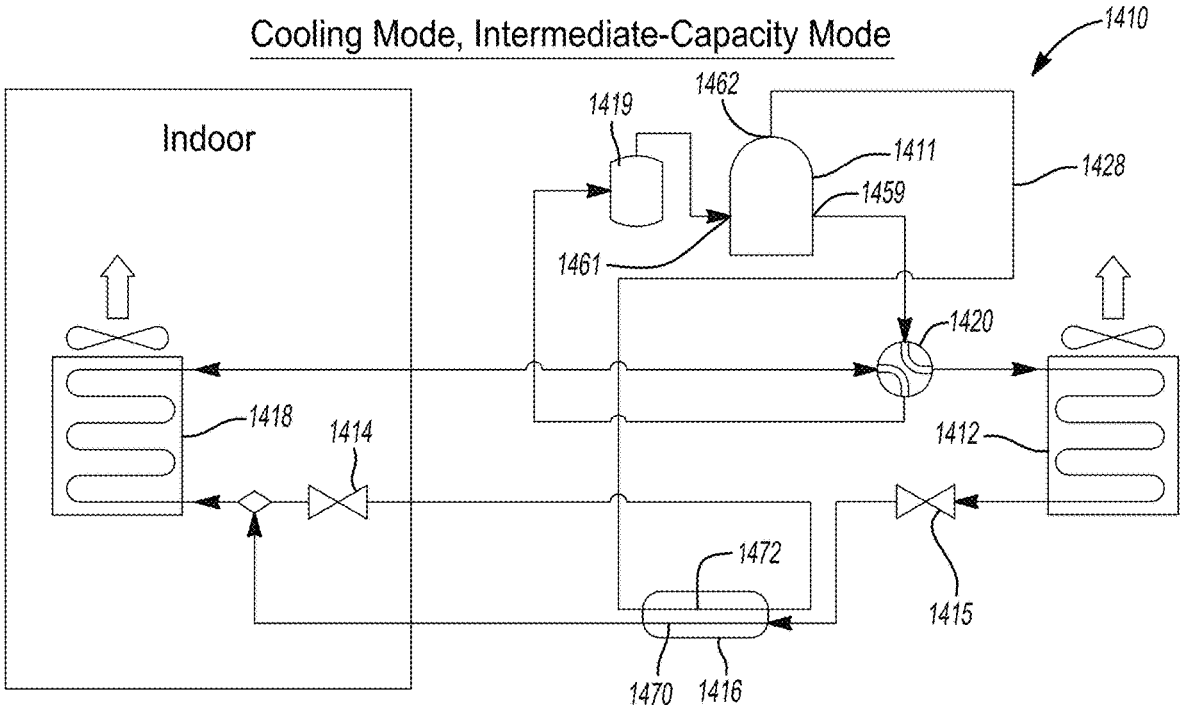
FIG. 24 is a schematic representation of the system of FIG. 22 operating in a cooling mode and the intermediate-capacity mode.

Referring now to FIGS. 22-24, another climate-control system 1410 is provided. The structure and function of the system 1410 may be similar or identical to that of the system 1210 except the system 1410 includes a plate-heat exchanger 1416 instead of the flash tank 1216. Like the system 1210, the system 1410 also includes a compressor 1411 (similar or identical to the compressor 1211), an outdoor heat exchanger 1412 (similar or identical to the outdoor heat exchanger 1212), first and second expansion devices 1414, 1415 (similar or identical to the expansion devices 1214), an indoor heat exchanger 1418 (similar or identical to the indoor heat exchanger 1218), a multiway valve 1420 (similar or identical to the multiway valve 1220), an accumulator 1419 (similar or identical to the accumulator 1219), and a capacity-modulation passage 1428 (similar or identical to the capacity-modulation passage 1228).

FIG. 22 shows the system 1410 operating in a heating mode and in a high-capacity mode. FIG. 23 shows the system 1410 operating in the heating mode and in an intermediate-capacity mode. FIG. 24 shows the system 1410 operating in a cooling mode and in the intermediate-capacity mode. While not specifically shown in the figures, in some configurations, the system 1410 may be operable in the high-capacity mode or a low-capacity mode while in the cooling mode and/or the system 1410 may be operable in a low-capacity mode while in the heating mode.

As noted above, FIG. 22 shows the system 1410 operating in the heating mode and in the high-capacity mode. In the heating mode, compressed working fluid from a discharge fitting 1459 (similar or identical to discharge fitting 1259) of the compressor 1411 flows through the multiway valve 1420 and flows to the indoor heat exchanger 1418. From the indoor heat exchanger 1418, a portion of the working fluid flows through a first passage in the plate-heat exchanger 1416 and then through the second expansion device 1415, through the outdoor heat exchanger 1412 and back to a suction inlet 1461 (similar or identical to suction inlet 1261) of the compressor 1411.

When the system 1410 is in the high-capacity mode, the first expansion device 1414 may open to allow a portion of fluid exiting the indoor heat exchanger 1418 to flow through a second passage 1472 of the plate-heat exchanger 1416. Heat may transfer between the fluid in the first and second passages 1472, 1470. Fluid exiting the second passage 1472 may flow through the capacity-modulation passage 1428 to a conduit 1462 of the compressor 1411 and then to a passage (similar or identical to passage 1264) in a scroll of the compressor 1411 to an intermediate pocket (similar or identical to intermediate pocket 1297), thereby raising the capacity of the compressor 1411.

In the intermediate-capacity mode, the first expansion device 1414 may close to restrict or prevent fluid flow through the second passage 1472 and the capacity-modulation passage 1428.

The system 1410 may include a control module (not shown) that controls operation of one or more of the compressor 1411, multiway valve 1420, expansion devices 1414, control valve 1468, and heat exchanger fans.

It will be appreciated that any of the systems 310, 610, 1010 described above could include fluid-injection structure and functionality such as the capacity-modulation passage 1228, control valve 1268, and flash tank 1216 (or plate-heat exchanger 1416) with any of the capacity modulation assemblies 28, 428, 728 to provide additional stages of capacity modulation for the compressor 10.

In this application, including the definitions below, the term "module" or the term "control module" may be replaced with the term "circuit." The term "module," "control module," "control circuitry," or "control system" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

In this application, apparatus elements described as having particular attributes or performing particular operations are specifically configured to have those particular attributes and perform those particular operations. Specifically, a description of an element to perform an action means that the element is configured to perform the action. The configuration of an element may include programming of the element, such as by encoding instructions on a non-transitory, tangible computer-readable medium associated with the element.

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll including a first end plate and a first spiral wrap extending from the first end plate;

a second scroll including a second end plate and a second spiral wrap extending from the second end plate, the first and second spiral wraps meshing with each other and forming a plurality of pockets therebetween, wherein the pockets include a radially outer pocket, a radially inner pocket, and an intermediate pocket disposed radially between the radially outer and inner pockets; and a capacity modulation assembly operable in a first capacity mode and a second capacity mode, wherein:

the capacity modulation assembly includes a valve ring and a modulation control valve, the valve ring is movable relative to the first scroll between a first position corresponding to the first capacity mode and a second position corresponding to the second capacity mode, the modulation control valve includes a valve body and a valve member that is movable relative to the valve body to cause corresponding movement of the valve ring between the first and second positions, the valve body includes a cavity in which the valve member is movably disposed, the valve body includes passages in fluid communication with the cavity, a first pressure differential between fluid in one of the passages and fluid in another of the passages causes movement of the valve member to cause corresponding movement of the valve ring from the first position to the second position, a second pressure differential between fluid in the one of the passages and fluid in the other of the passages causes movement of the valve member to cause corresponding movement of the valve ring from the second position to the first position.

2. The compressor of claim 1, wherein the passages of the valve body include: a first passage, a second passage, a third passage, a fourth passage, and a fifth passage.

3. The compressor of claim 2, wherein:

the first passage is in fluid communication with an axial biasing chamber, wherein the axial biasing chamber is defined by a floating seal assembly and the valve ring, the second passage is in fluid communication with a modulation chamber defined by the valve ring, the third and fifth passages are in fluid communication with a suction chamber of the compressor, and the fourth passage is fluidly connected to a conduit that extends out of the compressor.

4. The compressor of claim 3, wherein the valve member includes a main body and a stem, wherein the stem extends from the main body and is narrower than the main body.

5. The compressor of claim 4, wherein the main body includes a cutout that is in fluid communication with the second passage and the cavity of the valve body.

6. The compressor of claim 5, wherein the cavity is in selective fluid communication with the first passage and is in selective fluid communication with the third passage.

7. The compressor of claim 6, wherein the stem is received in the fourth passage when the cavity is in fluid communication with the first and second passages.

8. The compressor of claim 7, wherein the conduit extends through a shell assembly in which the first and second scrolls are housed.

9. A compressor comprising:

a first scroll including a first end plate and a first spiral wrap extending from the first end plate;

a second scroll including a second end plate and a second spiral wrap extending from the second end plate, the first and second spiral wraps meshing with each other and forming a plurality of pockets therebetween, wherein the pockets include a radially outer pocket, a radially inner pocket, and an intermediate pocket disposed radially between the radially outer and inner pockets; and a capacity modulation assembly operable in a first capacity mode and a second capacity mode, wherein the capacity modulation assembly includes a valve ring and a modulation control valve, wherein:

the valve ring is movable relative to the first scroll between a first position corresponding to the first capacity mode and a second position corresponding to the second capacity mode, the valve ring cooperates with a floating seal assembly to define an axial biasing chamber;

movement of the modulation control valve causes corresponding movement of the valve ring and switches the compressor between the first and second capacity modes, the modulation control valve includes a valve body and a valve member disposed within the valve body and movable relative to the valve body, the valve body includes a first passage, a second passage, a third passage, a fourth passage, and a fifth passage, the first passage is in fluid communication with the axial biasing chamber, the second passage is in fluid communication with a modulation chamber defined by the valve ring, the third and fifth passages are in fluid communication with a suction chamber of the compressor, and the fourth passage is fluidly connected to a conduit that extends out of the compressor.

10. The compressor of claim 9, wherein the valve member includes a main body and a stem, wherein the stem extends from the main body and is narrower than the main body.

11. The compressor of claim 10, wherein the main body includes a cutout that is in fluid communication with the second passage and a cavity of the valve body, wherein the valve member is movably disposed within the cavity.

12. The compressor of claim 11, wherein the cavity is in selective fluid communication with the first passage and is in selective fluid communication with the third passage.

13. The compressor of claim 12, wherein the stem is received in the fourth passage when the cavity is in fluid communication with the first and second passages.

14. The compressor of claim 13, wherein the conduit extends through a shell assembly in which the first and second scrolls are housed.

15. A compressor comprising:

a first scroll including a first end plate and a first spiral wrap extending from the first end plate;

a second scroll including a second end plate and a second spiral wrap extending from the second end plate, the first and second spiral wraps meshing with each other and forming a plurality of pockets therebetween, wherein the pockets include a radially outer pocket, a radially inner pocket, and an intermediate pocket disposed radially between the radially outer and inner pockets; and a capacity modulation assembly operable in a first capacity mode and a second capacity mode, wherein the capacity modulation assembly includes a valve ring and a modulation control valve, wherein:

the valve ring is movable relative to the first scroll between a first position corresponding to the first capacity mode and a second position corresponding to the second capacity mode, the valve ring defines an axial biasing chamber and a modulation chamber, and wherein a pressure differential between fluid in the axial biasing chamber and fluid in the modulation chamber causes movement of the valve ring relative to the first scroll, the modulation control valve includes a valve member that is movable to cause corresponding movement of the valve ring, and fluid from first and second sources exert first and second forces, respectively, on the valve member, and wherein a differential between the first and second forces moves the valve member to cause corresponding movement of the valve ring.

16. The compressor of claim 15, wherein the modulation control valve includes a valve body in which the valve member is movably disposed, and wherein the valve body includes a first passage, a second passage, a third passage, a fourth passage, and a fifth passage.

17. The compressor of claim 16, wherein:

the first passage is in fluid communication with the axial biasing chamber, the second passage is in fluid communication with a modulation chamber defined by the valve ring, the third and fifth passages are in fluid communication with a suction chamber of the compressor, and the fourth passage is fluidly connected to a conduit that extends out of the compressor.

18. The compressor of claim 17, wherein the valve member includes a main body and a stem, wherein the stem extends from the main body and is narrower than the main body.

19. The compressor of claim 18, wherein the main body includes a cutout that is in fluid communication with the second passage and a cavity of the valve body, wherein the valve member is movably disposed within the cavity.

20. The compressor of claim 19, wherein the cavity is in selective fluid communication with the first passage and is in selective fluid communication with the third passage.

21. The compressor of claim 20, wherein the stem is received in the fourth passage when the cavity is in fluid communication with the first and second passages.

22. The compressor of claim 21, wherein the conduit extends through a shell assembly in which the first and second scrolls are housed.

* * * * *